US008574798B2

(12) United States Patent
Iwanaga et al.

(10) Patent No.: US 8,574,798 B2
(45) Date of Patent: Nov. 5, 2013

(54) ELECTROPHOTOGRAPHIC PHOTORECEPTOR, AND IMAGE FORMING APPARATUS AND PROCESS CARTRIDGE USING THE SAME

(75) Inventors: Takeshi Iwanaga, Kanagawa (JP); Masayuki Nishikawa, Kanagawa (JP); Shigeru Yagi, Kanagawa (JP); Nobuyuki Torigoe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 401 days.

(21) Appl. No.: 12/534,541

(22) Filed: Aug. 3, 2009

(65) Prior Publication Data

US 2009/0297217 A1 Dec. 3, 2009

Related U.S. Application Data

(63) Continuation-in-part of application No. 12/239,350, filed on Sep. 26, 2008.

(30) Foreign Application Priority Data

Feb. 26, 2008 (JP) ..... 2008-044454
Dec. 15, 2008 (CN) ..... 2008 1 0184687
Feb. 12, 2009 (JP) ..... 2009-029833

(51) Int. Cl.
*G03G 5/04* (2006.01)

(52) U.S. Cl.
USPC ..... 430/66; 430/56; 430/57.1; 399/159

(58) Field of Classification Search
USPC ..... 430/108.1–108.3, 56, 57.1, 66; 399/159
See application file for complete search history.

(56) References Cited

U.S. PATENT DOCUMENTS 5,422,209 A * 6/1995 Ono et al. ..... 430/57.6
2007/0275315 A1* 11/2007 Nagatomo et al. ..... 430/108.1

FOREIGN PATENT DOCUMENTS

JP A-5-53487 3/1993
JP A-2004-151519 5/2004
JP A-2006-47656 2/2006
JP 2006267507 A * 10/2006
JP A-2006-267507 10/2006

OTHER PUBLICATIONS

English translation of JP 2006267507 A, Oct. 2006, Yagi et. al.*
Sep. 1, 2011 Office Action issued in U.S. Appl. No. 12/239,350.

* cited by examiner

*Primary Examiner* — Mark F Huff
*Assistant Examiner* — Rashid Alam
(74) *Attorney, Agent, or Firm* — Oliff & Berridge, PLC

(57) ABSTRACT

The present invention provides an electrophotographic photoreceptor having at least a photosensitive layer and a surface layer provided at a surface of the photosensitive layer. The surface layer contains a first layer which is provided at the photosensitive layer side and has a refractive index of n1 and a second layer which is provided at the opposite side of the first layer to the photosensitive layer and has a refractive index of n2. The refractive index of the photosensitive layer, the refractive index of the first layer, the refractive index of the second layer, the film thickness of the first layer, an integer of 0 or more, and the wavelength of light with which the surface of the photoreceptor is irradiated when an electrostatic latent image is formed satisfy specific relationships.

16 Claims, 8 Drawing Sheets

ELECTROPHOTOGRAPHIC PHOTORECEPTOR, AND IMAGE FORMING APPARATUS AND PROCESS CARTRIDGE USING THE SAME

CROSS-REFERENCE TO RELATED APPLICATIONS

This application is a continuation-in-part application of U.S. patent application Ser. No. 12/239,350 filed on Sep. 26, 2008, which is incorporated herein by reference and which is based on and claims priority on under 35 USC 119 from Japanese Patent Application No. 2008-044454 filed on Feb. 26, 2008. This application also claims priority under 35 USC 119 from Chinese Patent Application No. 200810184687.3 filed on Dec. 15, 2008 and Japanese Patent Application No. 2009-029833 filed on Feb. 12, 2009.

BACKGROUND

1. Technical Field

The invention relates to an electrophotographic photoreceptor, and an image forming apparatus and a process cartridge using the electrophotographic photoreceptor.

2. Related Art

In recent years, in image forming apparatuses utilizing electrophotographic methods, halftone reproduction has been demanded due to the requirements of colorization and high definition. Accordingly, in an electrophotographic photoreceptor (hereinafter, may be abbreviated as "photoreceptor") used for image forming apparatuses, reproducibility of the halftone, namely, reproducibility of the exposure potential, is required.

Further, from the viewpoint of reduction in service costs, reduction in the frequency of replacement of the electrophotographic photoreceptor is required and, therefore, extension of the lifetime of the photoreceptors has become an important technical issue. Organic photoreceptors and inorganic photoreceptors are known as electrophotographic photoreceptors. Although organic photoreceptors are superior to inorganic photoreceptors in terms of cost or the like, organic photoreceptors are inferior to inorganic photoreceptors since the former have a short life due to abrasion of an organic photosensitive layer.

Thus, in order to lengthen the operating life of the organic photosensitive layer, provision of a protective layer with a high hardness and abrasion resistance on the surface of the organic photosensitive layer has hitherto been investigated.

Since a protective layer inhibits abrasion of the organic photosensitive layer, the lifetime of the organic photosensitive layer may be greatly extended. However, even if the protective layer has superior durability, it may be abraded with long-term use. For example, when a member such as a charging roll, a cleaning blade, or an intermediate transfer medium, which is directly in contact with the photoreceptor, is disposed at the periphery of the photoreceptor, or when hard particles such as silica or cerium oxide are used as an external additive for toner, the protective layer may be abraded.

Further, when a protective layer is provided at the surface of an organic photosensitive layer, and is irradiated with light emitted from a monochromatic light source such as a laser diode or light emitting diode, the irradiation causes reflection of light at the interface between the protective layer and the organic photosensitive layer. The occurrence of light reflection means that the amount of light is reduced when light incident on the surface of the photoreceptor reaches the photosensitive layer.

SUMMARY

One aspect of the invention provides an electrophotographic photoreceptor including at least a photosensitive layer and a surface layer provided at the surface of the photosensitive layer, the surface layer including a first layer which is provided at a photosensitive layer side and has a refractive index of n1 and a second layer which is provided at an opposite side of the first layer to the photosensitive layer and has a refractive index of n2, and the photoreceptor satisfying the following Inequalities (1) to (3):

$$|n0-n2|>0.1 \quad \text{Inequality (1)}$$

$$n0<n1<n2, \text{ or } n0>n1>n2 \quad \text{Inequality (2)}$$

$$\lambda/(8\times n1)+a\times\lambda/(2\times n1)\leq d1\leq 3\times\lambda/(8\times n1)+a\times\lambda/(2\times n1) \quad \text{Inequality (3)}$$

wherein in Inequalities (1) to (3), n0 represents the refractive index of the photosensitive layer, n1 represents the refractive index of the first layer, n2 represents the refractive index of the second layer, d1 represents the film thickness (nm) of the first layer, a represents an integer of 0 or more, and λ represents the wavelength (nm) of light with which the surface of the photoreceptor is irradiated when an electrostatic latent image is formed.

BRIEF DESCRIPTION OF THE DRAWING

Exemplary embodiments of the invention will be described in detail based on the following figures, wherein.

DETAILED DESCRIPTION

Electrophotographic Photoreceptor

Figure 1:
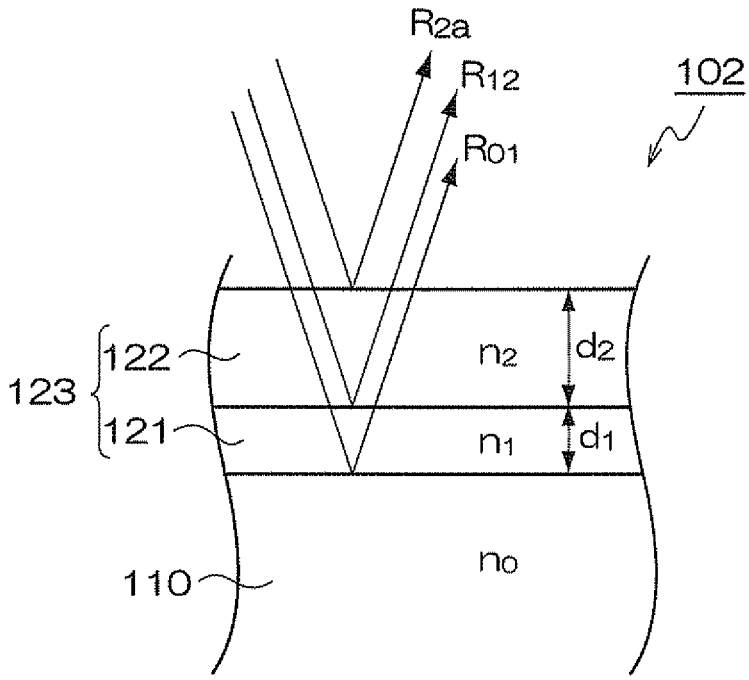
FIG. 1 is a schematic sectional view illustrating an example of the layer structure of a photoreceptor of an exemplary embodiment of the invention in which a surface layer having a two-layer structure is provided on the surface of the photosensitive layer.

The electrophotographic photoreceptor of the invention is an electrophotographic photoreceptor including a photosensitive layer and a surface layer provided at the surface of the photosensitive layer, the surface layer including a first layer which is provided at a photosensitive layer side and has a refractive index of n1 and a second layer which is provided at an opposite side of the first layer to the photosensitive layer and has a refractive index of n2, and the photoreceptor satisfying the following Inequalities (1) to (3):

$$|n0-n2|>0.1 \quad \text{Inequality (1)}$$

$$n0<n1<n2, \text{ or } n0>n1>n2 \quad \text{Inequality (2)}$$

$$\lambda/(8\times n1)+a\times\lambda/(2\times n1)\leq d1\leq 3\times\lambda/(8\times n1)+a\times\lambda/(2\times n1) \quad \text{Inequality (3)}$$

In Inequalities (1) to (3), n0 represents the refractive index of the photosensitive layer, n1 represents the refractive index of the first layer, n2 represents the refractive index of the second layer, d1 represents the layer thickness (mm) of the first layer, a represents an integer of 0 or more, and λ represents the wavelength of light with which the surface of the photoreceptor is irradiated when an electrostatic latent image is formed.

Here, when the photosensitive layer is configured by plural layers (for example, when configured by a charge transport layer and a charge generation layer), the refractive index n0 refers to the refractive index of a layer provided at the surface layer side.

Further, the refractive indices n0, n1 and n2 are the refractive indices at the wavelength of light incident on a photoreceptor (in general, this refers to the wavelength of a monochromatic light source such as a laser or light emitting diode, but also indicates the maximum wavelength when a range of wavelengths are used), and in a medium with light absorption, the refractive index is represented by the real number part n in the equation of: double refractive index n*=n+ik.

In the measurement of the refractive index, the real number part n and the imaginary part k in the double refractive index are obtained by measuring Δ and ϕ parameters which represent a state of polarized light measured by an ellipsometer, and which relate to the phase of the s and p polarized components and amplitude, respectively) at three incident angles in the range of from approximately 1,500 nm to approximately 200 nm with the use of a spectroscopic ellipsometer (trade name: M-2000, manufactured by J.A. Woollam Co. Inc.), and by analysis with analysis software WVAS32 and, further, the layer thicknesses d are determined. The samples used as specimens were obtained by forming only the layer to be measured on an Si substrate under conditions identical to the conditions when preparing the photoreceptor.

Further, the thickness of each layer is determined by observing cross-section images of the photoreceptor with a scanning electron microscope.

As described above, since the photoreceptor of the exemplary embodiment of the invention has a surface layer with a two-layer structure, and the refractive index and the layer thickness of each layer are set so as to satisfy Inequalities (1) to (3), generation of uneven surface potential at the surface of the photoreceptor after exposure may be suppressed, even when the surface of the photoreceptor is locally abraded. The principle according to which this effect may be attained will be explained with reference to the drawings.

Figure 8:
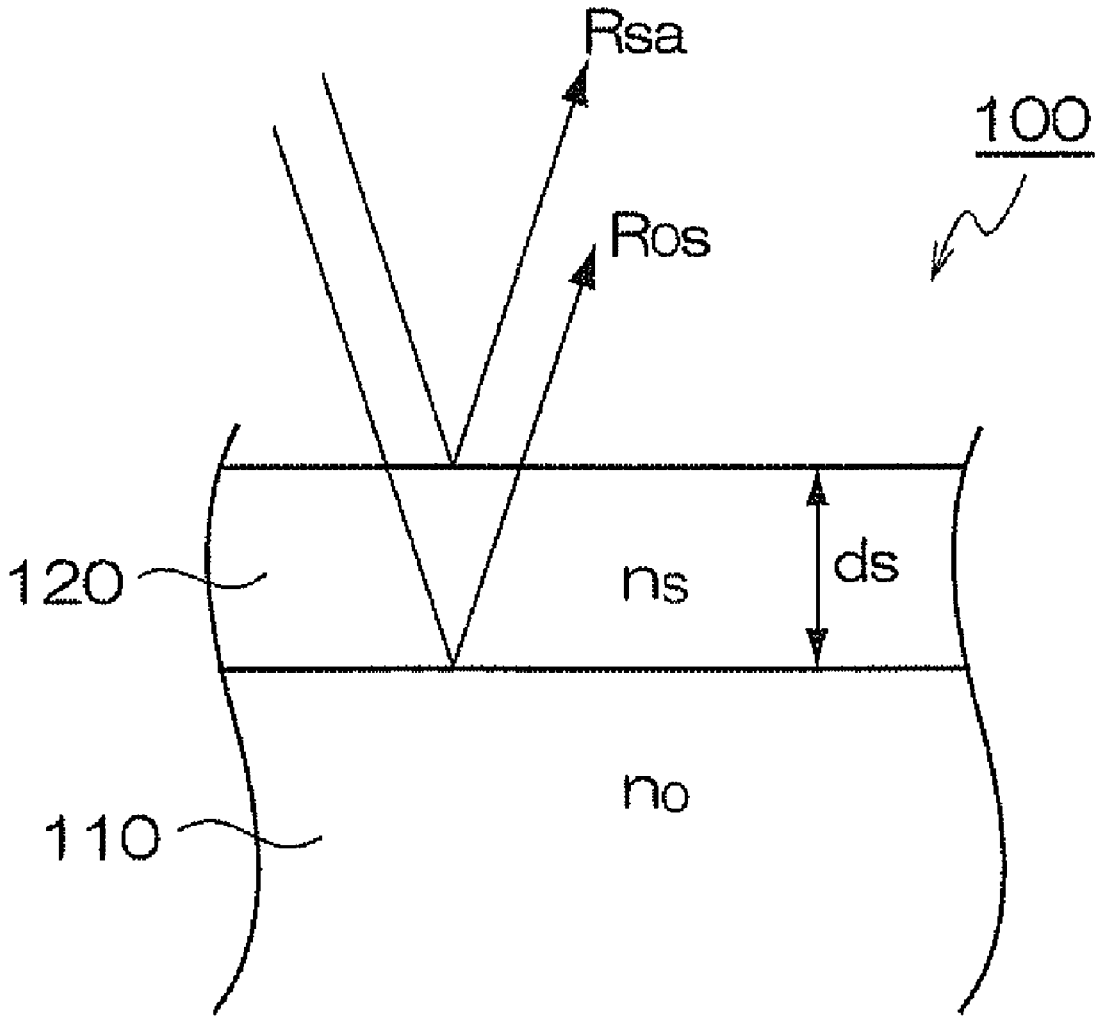
FIG. 8 RELATED ART
FIG. 8 is a schematic sectional view illustrating an example of the layer structure of a conventional photoreceptor, in which a single-layered surface layer is provided on the surface of the photoreceptor.

FIG. 8 is a schematic sectional view illustrating an example of a layer structure of a conventional photoreceptor, in which a surface layer having a single layer structure is provided on the surface of the photosensitive layer and, more specifically, illustrating the interference of exposure light. In FIG. 8, 100 represents a photoreceptor, 110 represents a photosensitive layer, 120 represents a surface layer (single-layered surface layer), n0 represents the refractive index of the photosensitive layer 110, ns represents the refractive index of the surface layer 120, ds represents the thickness of the surface layer 120, R0*s* represents the reflected light component from the interface between the photosensitive layer 110 and the surface layer 120, Rsa represents the reflected light component from the surface of the surface layer 120, and n0≠ns.

In the photoreceptor 100 of FIG. 8, although dependent on the layer thickness ds, the phases of the reflected light components R0*s* and Rsa are mutually weakened when both components are in an anti-phase condition, and the phases are mutually strengthened with when both reflected light components are completely in the in-phase condition. When local abrasion of the surface layer advances, the transmittance of the incident light varies depending on the location on the surface of the photoreceptor due to this kind of interference effect. Accordingly, when the difference between n0 and ns is large, uneven surface potential is consequently generated at the surface of the photoreceptor after exposure.

FIG. 1 is a schematic sectional view illustrating an example of a layer structure of a photoreceptor of the exemplary embodiment of the present invention, in which a surface layer having a two-layer structure is provided on the surface of a photosensitive layer and, more specifically, illustrating the interference of exposure light. In FIG. 1, 102 represents a photoreceptor, 110 represents a photosensitive layer, 121 represents a first layer, 122 represents a second layer, 123 represents a surface layer (a two-layered surface layer formed of the first layer 121 and a second layer 122), n0 represents the refractive index of the photosensitive layer 110, n1 represents the refractive index of the first layer 121, n2 represents the refractive index of the second layer 122, d1 represents the thickness of the first layer 121, d2 represents the thickness of the second layer 122, R01 represents a reflected light component from the interface between the photosensitive layer 110 and the first layer 121, R12 represents a reflected light component from the interface between the first layer 121 and the second layer 122, R2*a* represents a reflected light component from the surface of the second layer 122, and n0, n1 and n2 satisfy the relationship of n0>n1>n2, or, n0<n1<n2.

In the photoreceptor 102 of FIG. 1, while dependent on the layer thicknesses d1 and d2, interference occurs between the three reflected light components R01, R12 and R2*a*.

Here, when it is assumed that the reflected light components R01 and R12 are in the anti-phase condition, (1) if the reflected light components R01, and R12 are in the in-phase condition, R01 becomes anti-phase with respect to the reflected light components R2*a* and R12, and (2) if the reflected light components R2*a* and R01 are in the in-phase condition, R12 becomes anti-phase with respect to the reflected light components R2*a* and R01. Accordingly, even if local abrasion of the surface layer 123 advances, as long as the abrasion is generated within the second layer 122, any one of the components may act to suppress interference since the phases of the reflected light components do not all come into the in-phase condition, unlike the case shown in FIG. 8. Accordingly, even when the difference between n0 and n2 becomes large, the uneven surface potential generated at the surface of the photoreceptor after exposure may be suppressed. Furthermore, this effect may be obtained even when phases of the reflected light components R01 and R12 are not completely in the anti-phase condition, when the phases of the reflected light components R01 and R12 mutually canceling the interference to some extent.

In addition, a similar idea may be applied to a case in which the surface layer has a multilayer structure formed of three or more layers, or has an inclined structure such that the refractive index changes (increases or decreases) continuously toward the surface side of the surface layer from the photosensitive layer side in the thickness direction of the surface layer.

Hereinafter, the above Inequalities (1) to (3) will be explained in detail.

In the photoreceptor of the exemplary embodiment of the present invention, as shown in Inequality (1), the absolute value of the difference between the refractive index n0 of the photosensitive layer and the refractive index n2 of the second layer (hereinafter, also referred to as "Δn") is necessarily larger than 0.1. This is because the uneven surface potential after exposure which is generated at the surface of the photoreceptor due to the unevenness of the layer thickness of the surface layer cannot be generated unless a certain amount of difference in refractive index exists between the photosensitive layer and the surface layer.

When the second layer is formed from known materials for the surface layer, and the photosensitive layer is also formed from known materials for the photosensitive layer, most combinations of these materials may satisfy the difference in the refractive indices of Inequality (1). Representative examples include a case in which the photosensitive layer is formed from materials for an organic photosensitive layer or materials for an inorganic photosensitive layer, and the second layer is formed from inorganic materials for the above surface layer.

Accordingly, Δn is required to be larger than approximately 0.1, and is preferably approximately 0.2 or more.

Moreover, as shown in Inequality (2), the refractive indices of n0, n1 and n2 of the photosensitive layer, the first layer and the second layer, respectively, are required to satisfy a relationship such that the refractive indices increase or decrease in this order. When Inequality (2) is not satisfied, the effect may not be obtained since interference stronger than that produced in a single layer is caused Furthermore, as shown in the following Inequality (4), in order to maximize the interference suppression effect among the three reflected light components, the value of the refractive index n1 is preferably around the mean value of the refractive index n0 and the refractive index n2.

$$(n0+n2)/2-|(n0-n2)/4|\leq n1\leq(n0+n2)/2+|(n0-n2)/4| \quad \text{Inequality (4)}$$

In Inequality (4), n0 represents the refractive index of the photosensitive layer, n1 represents the refractive index of the first layer, and n2 represents the refractive index of the second layer.

When the diffractive index n1 is outside the above range, the interference suppression effect among the three reflected light components may not be obtained and, consequently, the uneven surface potential at the surface of the photoreceptor after exposure may occur. n1 is more preferably in a range of from $(n0+n2)/2-|(n0-n2)/8|$ to $(n0+n2)/2+|(n0-n2)/8|$.

Further, in the exemplary embodiment of the present invention, the thickness d1 of the first layer is required to satisfy Inequality (3). In the first layer, the length corresponding to one cycle of the wavelength λ of light (exposure wavelength) incident on the surface of the photoreceptor when forming an electrostatic latent image, is $\lambda/(2\times n1)$. Therefore, when the thickness d1 can assume a value close to an integral multiple of the above value (namely, when the thickness d1 is a value outside the range of Inequality (3)), the effect of canceling the interference among the reflected light components R01, R12 and R2*a* becomes insufficient, and uneven surface potentials after exposure may be generated at the surface of the photoreceptor.

Here, as shown in Inequality (3), the layer thickness d1 (nm) is required to be in a range of $\lambda/(8\times n1)+\lambda/(2\times n1)\leq d1\leq 3\times\lambda(8\times n1)+a\times\lambda/(2\times n1)$, preferably in a range of $3\times\lambda/(16\times n1)+a\times\lambda/(2\times n1)\leq d1\leq 5\times\lambda/(16\times n1)+a\times\lambda/(2\times n1)$, and is most preferably $\lambda/(4\times n1)+a\times\lambda/(2\times n1)$.

In Inequality (3), a is not specifically limited, as long as a is an integer of 0 or more, and may be selected depending on the required thickness of the second layer. When the first layer is inferior in mechanical properties, light transmittance, electroconductivity or the like with respect to the second layer, a=0 is preferable in view of the properties.

The layer thickness of the second layer d2 is not specifically limited, but may be selected from the viewpoint of ensuring mechanical properties and abrasion tolerance, or suppressing absorption loss of light of the second layer. When the second layer is formed from an inorganic material, the thickness of the second layer is preferably from approximately 50 nm to approximately 2,000 nm, and more preferably from approximately 100 nm to approximately 1,000 nm. When the thickness d2 is less than approximately 50 nm, the abrasion tolerance is too small, and abrasion may proceed to the first layer if the photoreceptor is used over a long period of time. Since a location at which abrasion proceeds to the first layer is then in a similar condition to when a single-layered protective layer is formed on the photosensitive layer as shown in FIG. 8, an uneven surface potential after exposure may be generated at the surface of the photoreceptor. When the thickness d1 exceeds approximately 2,000 nm, the absorption loss of light caused by the second layer may become larger.

Further, when the second layer has a structure formed by dispersing filler in a resin or a resin matrix, from the viewpoint similar to the above, the thickness d1 is preferably from approximately 100 nm to approximately 20,000 nm, and more preferably from approximately 1,000 nm to approximately 10,000 nm.

Further, the invention may exert its effect when a difference in the layer thickness is caused in an evenly formed surface layer due to localized abrasion, and also exerts its effect when the difference in the layer thickness is caused at the time of layer formation.

Layer Structure of Photoreceptor

Hereinafter, the layer structure of the photoreceptor of the exemplary embodiment of the present invention is explained.

The photoreceptor of the exemplary embodiment of the present invention has a photosensitive layer and a surface layer provided on the photosensitive layer, and is not specifically limited as long as the surface layer includes a first layer and a second layer. The photosensitive layer is generally provided on a substrate having electroconductivity (electroresistivity being less than approximately $10^{13}$ Ωcm in volume resistivity; hereinafter, the same applies) (hereinafter, abbreviated as "conductive substrate"). If required, an intermediate layer such as a undercoat layer may be provided between the conductive substrate and the photosensitive layer.

The photosensitive layer may consist of two or more layers, or may be functionally separated. The photoreceptor of the exemplary embodiment of the present invention may be an amorphous silicon photoreceptor containing silicon atoms in the photosensitive layer, or an organic photoreceptor containing an organic polymer such as an organic photosensitive material in the photosensitive layer. Hereinafter, a specific example of the layer structure of a photoreceptor of an exemplary embodiment of the invention will be described in detail with reference to the drawings.

Figure 2:
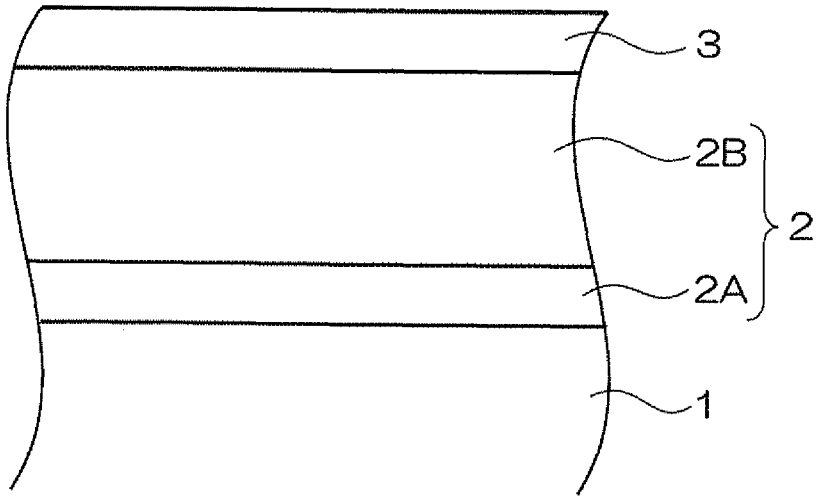
FIG. 2 is a schematic sectional view illustrating an example of the layer structure of the photoreceptor of an exemplary embodiment of the invention.

FIG. 2 is a schematic sectional view illustrating an example of the layer structure of a photoreceptor of an exemplary embodiment of the invention, wherein 1 represents a conductive substrate, 2 represents a photosensitive layer, 2A represents a charge generation layer, 2B represents a charge transport layer, and 3 represents a surface layer. In FIG. 2, a first layer and a second layer constituting the surface layer 3 are not shown (hereinafter, the same applies in FIG. 3).

The photoreceptor shown in FIG. 2 has a layer structure in which the charge generation layer 2A, the charge transport layer 2B, and the surface layer 3 are formed on the conductive substrate 1 in this order. The photosensitive layer 2 has a two-layered structure, formed of the charge generation layer 2A and the charge transport layer 2B.

Figure 3:
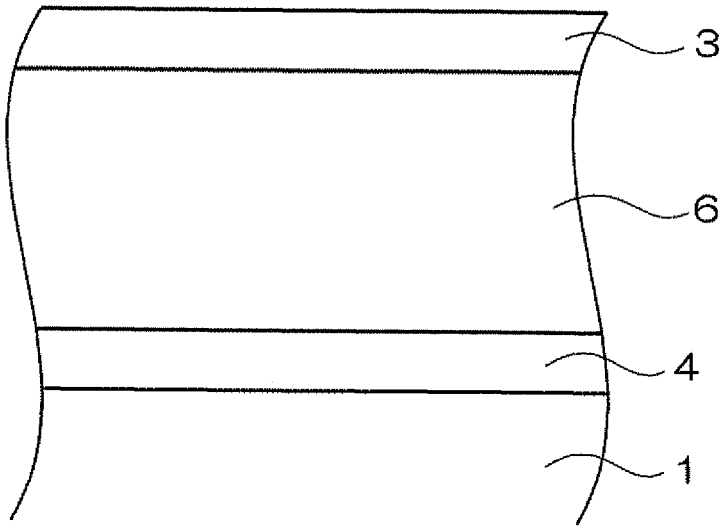
FIG. 3 is a schematic sectional view illustrating another example of a layer structure of the photoreceptor of an exemplary embodiment of the invention.

FIG. 3 is a schematic sectional view illustrating another example of a layer structure of a photoreceptor of an exemplary embodiment of the invention, wherein 6 represents the photosensitive layer, 4 represents an undercoat layer, and the remainder is the same as shown in FIG. 2.

The photoreceptor shown in FIG. 3 has a layer structure in which the undercoat layer 4, the photosensitive layer 6 and the surface layer 3 are formed on the conductive substrate 1 in this order. The photosensitive layer 6 is a layer having integrated functions of both the charge generation layer 2A and the charge transport layer 2B shown in FIG. 2.

In the exemplary embodiment of the invention, the photosensitive layers 2 and 6 may be formed of an organic material or an inorganic material, or a combination thereof.

Organic Photoreceptor

Hereinafter, an exemplary embodiment of a preferable configuration of the photoreceptor of the invention in a case in which it is an organic photoreceptor will be described. The organic polymer compound included in the photosensitive layer may be thermoplastic or thermosetting, or may be formed by reacting two types of molecules.

In the case of an organic photoreceptor, the photosensitive layer may be a functionally separated layer having a charge generation layer and a charge transport layer as shown in FIG. 2, or a functionally integrated layer as shown in FIG. 3, In the case of a functionally separated layer, a charge generation layer may be formed at the surface side of the photoreceptor or a charge transport layer may be formed at the surface side.

Amorphous Silicon Photoreceptor

Hereinafter, an exemplary embodiment of a preferable configuration of the photoreceptor of the invention in a case in which it is an amorphous silicon photoreceptor will be described.

The amorphous silicon photoreceptor may be a photoreceptor for positive charging or negative charging. A photoreceptor, which is formed by coating an undercoat layer on a conductive substrate for blocking charge injection and improving adhesive property, and then coating a photoconductive layer and a surface layer thereon, may be used.

The top layer of the photosensitive layer (the layer on the surface layer side) may be p-type amorphous silicon or n-type amorphous silicon.

Surface Layer

Next, the surface layer is described in detail.

The surface layer provided on the surface of the photosensitive layer is not specifically limited, as long as the surface layer includes a first layer and a second layer.

In the photoreceptor according to an exemplary embodiment of the invention, the refractive indices and the layer thicknesses of the photosensitive layer, the first layer and the second layer are combined so as to satisfy the above Inequalities (1) to (3), so that interference between the reflected light components from the interfaces among these layers are suppressed, and generation of uneven surface potential at the surface of the photoreceptor after exposure is suppressed. To the extent that the action of this effect is not hindered, an intermediate layer may be provided, for example, at the lower side of the surface layer (namely, between the photosensitive layer and the surface layer), or between the first layer and the second layer. The refractive index of the intermediate layer is not specifically limited, but from the viewpoint that the action of the effect is not hindered, the thickness of the intermediate layer is preferably approximately 50 nm or less, and more preferably approximately 25 nm or less, depending on the refractive index of the intermediate layer.

As materials for forming the second layer at the surface side of the surface layer, the materials used for the surface layer of the photoreceptor may be used. As the materials, from the viewpoint of mechanical durability, for example, carbon materials such as amorphous carbon, oxide materials such as aluminum oxide and gallium oxide, or nitride materials such as carbon nitride may be used.

The amorphous carbon in an exemplary embodiment of the invention refers to an amorphous carbon hard film formed from mainly carbon and hydrogen atoms, and the concentration of hydrogen is approximately 60% or less. In general, the less the hydrogen content and the higher the sp3 carbon component ratio, the more the amorphous carbon is diamond-like and harder.

Of these materials, materials containing amorphous carbon, Ga, oxygen and hydrogen may be used. When these materials are used, in the photosensitive layer formed from an organic photosensitive layer, it becomes easy to satisfy Inequalities (2) and (4) and, as a result, generation of the uneven surface potential at the surface of the photoreceptor after exposure can be easily suppressed. Further, in consideration of suppression of an increase in residual potential on the photoreceptor during cyclic use, materials containing Ga, oxygen and hydrogen may be preferably used. The second layer formed from these inorganic materials may be either amorphous or crystalline.

For example, the refractive index of materials containing Ga, oxygen and hydrogen is from about 1.7 to about 2.0, and the refractive index of the amorphous carbon is from about 1.5 to about 2.4, although the refractive index of the above materials varies depending on the composition or production conditions thereof. The refractive index of the organic photosensitive layer is from about 1.5 to about 1.75, and the refractive index of the inorganic photosensitive layer (amorphous silicon layer) is from about 3.0 to about 4.0, although the refractive index varies depending on the composition thereof.

As the materials for forming the first layer at the photosensitive side of the surface layer, the materials used for the above-mentioned second layer may be used. When materials having a similar composition to those used in the second layer are used for the first layer, the composition of the materials configuring the first layer is selected so as to be slightly different from the composition of the materials configuring the second layer such that the refractive indices of the first and the second layers satisfy Inequality (2). When the compositions of materials for the first and second layers are the same, the film-forming conditions for the second layer is selected so as to be different from those for the first layer.

Of the first layer and the second layer of the surface layer, the second layer of the surface layer is generally required to have greater abrasion resistance and mechanical durability. For this reason, materials other than the above inorganic materials that have excellent abrasion resistance and mechanical durability may be used for the first layer as needed. Examples of such other materials include a resin material.

When the photosensitive layer is an organic photosensitive layer, examples of the combination of constituent materials of the first layer and the second layer include: (the first layer: the second layer)=(material containing Ga, oxygen and hydrogen:material containing Ga, oxygen and hydrogen); (amorphous carbon:amorphous carbon); (material containing Ga, oxygen and hydrogen:material containing Ga, nitrogen and hydrogen); and (material containing Al, oxygen and hydrogen:material containing Ga, oxygen and hydrogen).

Similarly, when the photosensitive layer is an inorganic photosensitive layer (amorphous silicon layer), examples of the combination of constituent materials of the first layer and the second layer include: (the first layer: the second layer)=(silicon carbide:silicon nitride).

Hereinafter, a case in which a material containing Ga, oxygen and hydrogen is used in the surface layer is explained in more detail.

The composition of the material containing Ga, oxygen and hydrogen is not specifically limited, but a composition of $GaO_x$:H (x being in a range of about 1.1 to about 1.4) is particularly preferable from the following viewpoints: (1) the material may have an appropriate electroconductivity; (2) the material may suppress the increase in residual potential on the photoreceptor during cyclic use, even when the thickness of the surface layer exceeds about 0.2 μm; and (3) the material may easily satisfy Inequalities (2) or (4) when the photosensitive layer is an organic photosensitive layer (in particular, an organic photosensitive layer containing a polycarbonate as a main component). In this case, from the viewpoint that Inequalities (2) or (4) are easily satisfied, the photosensitive layer (the layer at the surface side when the photosensitive layer has multilayer structure) is preferably an organic photosensitive layer containing a polycarbonate as a main component.

In the system that uses the composition of $GaO_x$:H (x being in a range of about 1.1 to about 1.4), the electric resistance increases and the refractive index decreases with an increase in x. Accordingly, for example, when an organic photosensitive layer with a refractive index of approximately 1.65 is formed as the photosensitive layer and a surface layer is formed of the material having the composition of $GaO_x$:H (x being in a range of about 1.1 to about 1.4), by setting x in the second layer at the surface side of the surface layer to be relatively small, and x in the first layer at the photosensitive layer side of the surface layer to be relatively large, the relationship of n2>n1>n0 may be satisfied.

Here, in this case, while an increase in the electric resistance in the first layer may adversely affect the electrical properties of the photoreceptor, this may be prevented by reducing the thickness d1 of the first layer to as thin as possible within the range of Inequality (3).

Further, in the system that uses the composition of $GaO_x$:H (x being in a range of about 1.1 to about 1.4), as a method of controlling the refractive index, a method of adding carbon is exemplified, in addition to the method of controlling x. In this case, in order to reduce the refractive index, the addition amount of carbon is increased. For example, when an organic photosensitive layer with a refractive index of about 1.6 is formed as a photosensitive layer and the surface layer is formed of a material having the composition of $GaO_x$:H (x being in a range of about 1.1 to about 1.4) with addition of carbon, by setting the amount of carbon in second layer at the surface side of the surface layer to be relatively low or to be carbon-free, and by setting the content of carbon in the first layer at the photosensitive layer side of the surface layer to be relatively high, the relationship of n2>n1>n0 may be satisfied.

Although an increase in the amount of carbon may cause deterioration in mechanical strength or abrasion resistance, shortening of the photoreceptor life does not occur since the deterioration in the above properties occurs within the first layer which does not constitute the surface of the surface layer.

In an exemplary embodiment of the invention, the contents of the elements such as Ga and oxygen in the surface layer and the distribution thereof in the film thickness direction are determined by Rutherford back scattering (hereinafter, referred to as "RBS" in some cases) in the following manner.

For RBS, an accelerator (trade name: 3SDH PELLETRON, manufactured by NEC corporation), an end station (trade name: RBS-400, manufactured by CE & A Co., Ltd.), and a system (trade name: 3S-R10) are used. The data is analyzed using HYPRA program (trade name, provided by CE & A Co., Ltd.).

As for RBS measuring condition, He++ ion beam energy is 2.275 eV; detection angle is 160°; grazing angle with respect to incident beam is 109°±2°.

The RBS measurement is specifically performed in the following manner.

First, $He^{++}$ ion beam is irradiated vertically on a sample; a detector is placed at an angle of 160° with respect to the ion beam; and the signal of He backscattered backward is determined. The composition ratio and the film thickness thereof are determined from He energy and intensity detected. The spectrum may be measured from two detection angles, for improvement in the measurement accuracy of composition ratio and film thickness. The measurement accuracy may be improved by crosschecking the results by measurement from two detection angles different in resolutions in the depth direction and backward scattering kinetics.

The number of He atoms scattered backward by the target atom depends only on three components: 1) the atomic number of target atom, 2) the energy of He atom before scattering, and 3) the scattering angle. The density is calculated from the measured composition, and the film thickness is calculated from the density. The error of density is not more than 20%.

The hydrogen content are determined by hydrogen forward scattering (hereinafter, referred to as "HFS" in some cases) in the following manner.

For HFS, an accelerator (trade name: 3SDH PELLETRON, manufactured by NEC), an end station (trade name: RBS-400, manufactured by CE & A Co., Ltd.), and a system (trade name: 3S-R10) are used. The data is analyzed using HYPRA program (trade name, provided by CE & A Co., Ltd.).

As for RBS measuring condition, $He^{++}$ ion beam energy is 2.275 eV; detection angle is 160°; grazing angle with respect to incident beam is 30°.

In HFS measurement, hydrogen signals scattered in front of a sample are collected by placing a detector at a position at an angle of 30° with respect to the $He^{++}$ ion beam, and placing a sample at an angle of 75° with respect to the normal line. The detector is preferably covered with a thin aluminum foil to remove He atoms scattered with hydrogen. The amount is determined by comparing the hydrogen counts of a test sample with that of a reference sample after normalization with blocking power. The reference sample used is Si sample injected with H ion, or white mica. The white mica is known to have a hydrogen concentration of approximately 6.5 atomic %. The amount of H absorbed on the outmost layer can be calculated by subtracting the H amount adsorbed on a clean Si surface.

The elemental composition in the depth direction is determined by, for example, a method of collecting profile data of depth from the surface, a method of measuring the surface with the surface being etched by sputtering in a vacuum, or a method of mapping the composition of a sectional sample. The method may be selected in accordance with the analysis method.

Method of Forming the Surface Layer

Hereinafter, the method of forming the surface layer in the exemplary embodiment of the invention will be described. The surface layer may be formed by a known gas-phase film-forming method, such as a plasma CVD (chemical vapor deposition) method, an organometallic gas-phase growth method, a molecular beam epitaxy method, or a sputtering method. When the first layer provided at the photosensitive layer side of the surface layer is not formed of a hard inorganic material, in addition to the above film-forming methods, known liquid phase film-forming methods such as a dip coating method may be used.

When the surface layer has a two-layered structure as shown in FIG. 1, or has a multilayer structure formed of three or more layers, a different film-forming condition or a different film-forming method is applied for the formation of each layer so that the relationship in Inequality (2) may be satisfied.

When the surface layer has a structure with a continuously varying refractive index in the film thickness direction, the layer formation can be carried out such that the film-forming conditions are gradually changed with time during layer formation. Alternatively, after a surface layer with a single layer structure having a uniform composition in the film thickness direction is formed, a distribution in ion concentration in the film thickness direction of the surface layer is provided by injecting an ion to the surface of the surface layer, and the profile of the composition is controlled, thereby forming a surface layer with a continuously varying refractive index in the film thickness direction. Furthermore, the refractive index of amorphous carbon may be changed by irradiation with ions such as He and the like, or a radiation beam.

Hereinafter, an exemplary embodiment of an apparatus used in forming the surface layer will be described with reference to drawings.

Figure 4A:
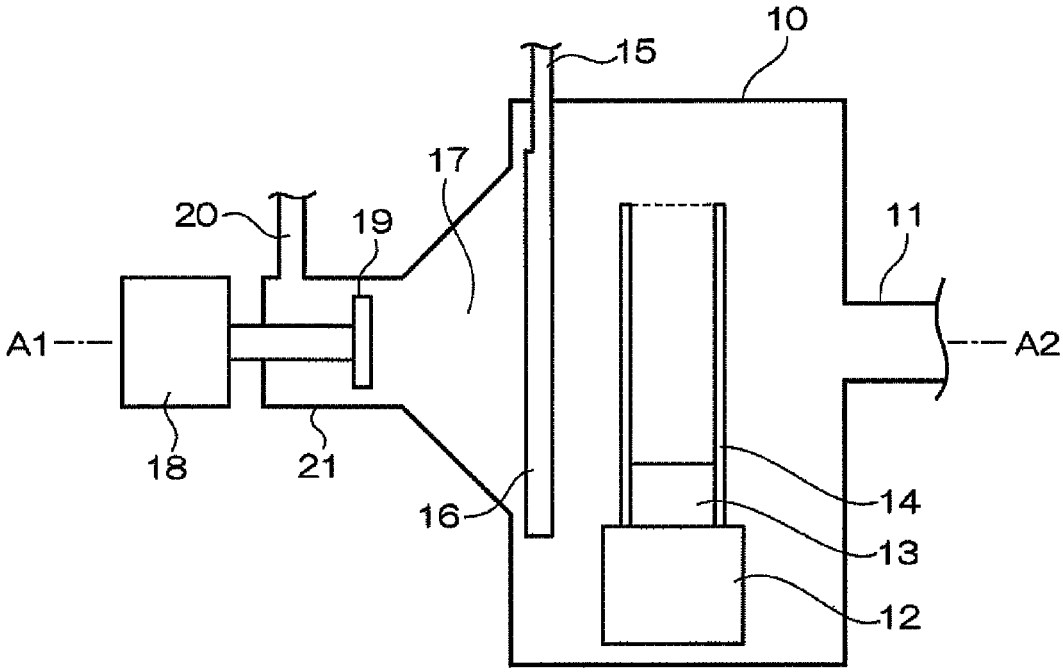
FIGS. 4A and 4B are schematic views illustrating an example of a film-forming apparatus used when forming the surface layer of the photoreceptor of an exemplary embodiment of the invention.
Figure 4B:
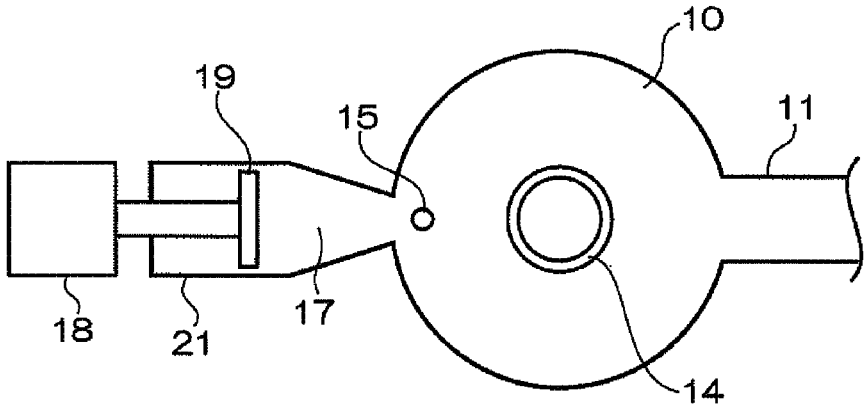

FIGS. 4 A and 4B are schematic views illustrating an example of the film-forming apparatus used in forming the surface layer of the photoreceptor of an exemplary embodiment of the invention; FIG. 4A is a schematic sectional view illustrating the side view of the film-forming apparatus; and FIG. 4B is a schematic sectional view illustrating the film-forming apparatus shown in FIG. 4A as seen along the line A1 to A2. In FIGS. 4 A and 4B, 10 represents a film-forming chamber, 11 represents an exhaust vent, 12 represents a substrate-rotating unit, 13 represents a substrate holder, 14 represents a substrate, 15 represents a gas inlet, 16 represents a shower nozzle, 17 represents a plasma diffusion unit, 18 represents a high-frequency power supply unit, 19 represents a flat plate electrode, 20 represents a gas-supply tube, and 21 represents a high-frequency discharge tube unit.

In the film-forming apparatus shown in FIGS. 4 A and 4B, the exhaust vent 11 connected to a vacuum exhaust device not shown in Figures is connected to one terminal of the film-forming chamber 10, and a plasma-generating unit including a high-frequency power supply unit 18, the flat plate electrode 19 and the high-frequency discharge tube unit 21 is provided on the side opposite to the exhaust vent 11 of the film-forming chamber 10.

The plasma-generating unit has a high-frequency discharge tube unit 21, the flat plate electrode 19 placed in the high-frequency discharge tube unit 21 with its discharge face facing the exhaust vent 11, and the high-frequency power supply unit 18 placed outside the high-frequency discharge tube unit 21 and connected to the face opposite to the discharge face of the flat plate electrode 19. The gas-supply tube 20 for supplying a gas into the high-frequency discharge tube unit 21 is connected to the high-frequency discharge tube unit 21, and the other end of the gas-supply tube 20 is connected to a first gas supply source not shown in the Figures.

Figure 5:
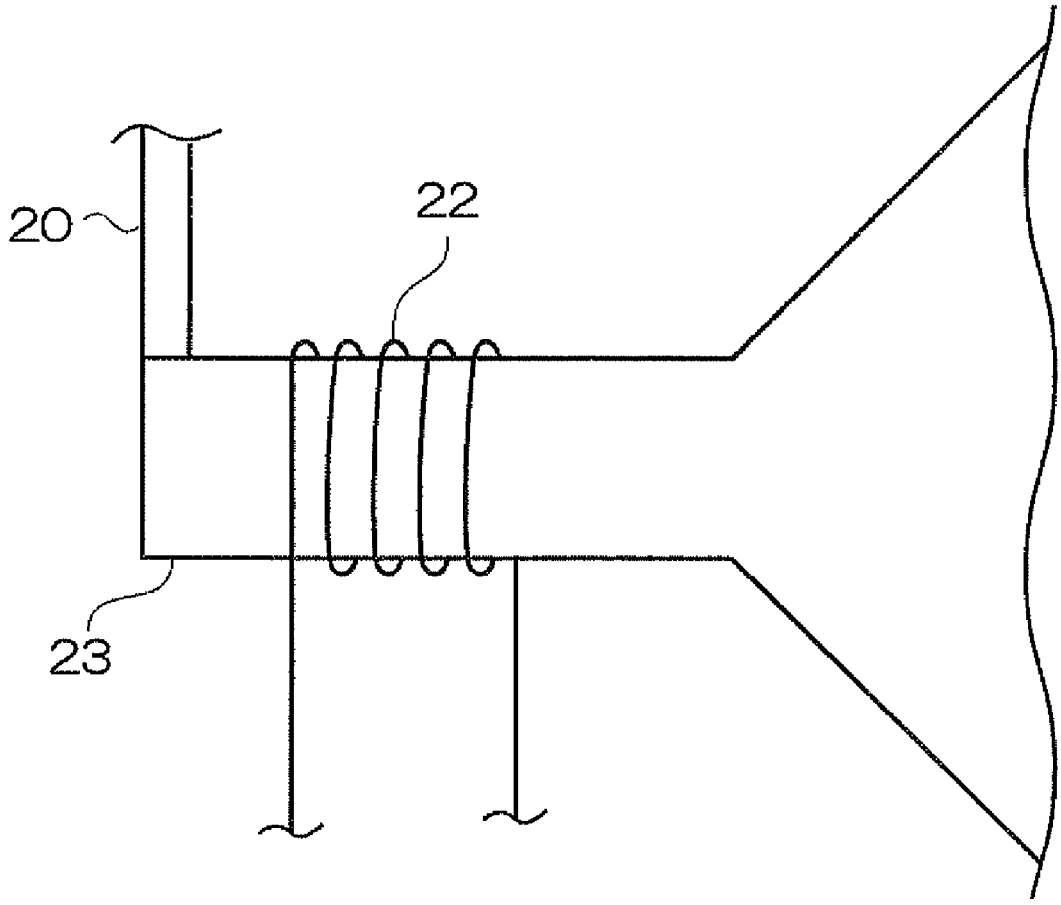
FIG. 5 is a schematic view illustrating an another example of a plasma-generating unit that can be used in the film-forming apparatus shown in FIGS. 4A and 4B.

The plasma-generating unit installed in the film-forming apparatus shown in FIGS. 4 A and 4B may be replaced with the plasma-generating unit shown in FIG. 5. FIG. 5 is a schematic view illustrating another example of the plasma-generating unit that can be used in the film-forming apparatus shown in FIGS. 4 A and 4B, and a side view of the plasma-generating unit. In FIG. 5, 22 represents a high-frequency coil, 23 represents a quartz pipe, and 20 is the same as 20 in FIGS. 4 A and 4B. The plasma-generating unit has a quartz pipe 23 and a high-frequency coil 22 formed along the peripheral surface of the quartz pipe 23, and the other terminal of the quartz pipe 23 is connected to a film-forming chamber 10 (not shown in FIG. 5). The other end of the quartz pipe 23 is connected to the gas-supply tube 20 for supplying gas into the quartz pipe 23.

A rod-shaped shower nozzle 16 almost in parallel with the discharge face is connected to the discharge face side of flat plate electrode 19; one end of the shower nozzle 16 is connected to a gas inlet 15; and the gas inlet 15 is connected to a second gas supply source not shown in Figure provided outside the film-forming chamber 10.

A substrate-rotating unit 12 is provided in the film-forming chamber 10; and a cylindrical substrate 14 is connected via a substrate holder 13 to the substrate-rotating unit 12 with the longitudinal direction of the shower nozzle almost in parallel with the axial direction of the substrate 14. During film formation, the substrate 14 is rotated in the circumferential direction by rotation of the substrate-rotating unit 12. A photoreceptor which a photosensitive layer has been formed is used as the substrate 14.

Hereinafter, an example of surface layer formation using a film-forming apparatus shown in FIGS. 4A and 4B, in which the surface layer is formed from a material containing Ga, oxygen and hydrogen, is described First, together with the introduction of a mixed gas Of $O_2$ and $N_2$, which has been diluted with He, into the high-frequency discharge pipe 21 through the gas-supply tube 20, a radiofrequency wave at about 13.56 MHz is applied to the flat plate electrode 19 from the high-frequency power supply unit 18. A plasma diffusion unit 17 is formed such that the wave then travels radially from the discharge face side of the flat plate electrode 19 to the exhaust vent 11 side.

Next, by introducing gaseous trimethylgallium, which has been diluted with hydrogen using hydrogen as a carrier gas, into the film-forming chamber 10 via a gas inlet 15 and a shower nozzle 16, a film containing hydrogen, nitrogen and gallium is formed on the surface of the substrate 14.

The temperature during film formation of a surface layer is not particularly limited, but when an amorphous silicon photoreceptor is formed, the temperature during film formation is preferably from approximately 50° C. to approximately 350° C., and when an organic photoreceptor is formed, the temperature during film formation is preferably from approximately 20° C. to approximately 100° C.

When an organic photoreceptor is formed, the temperature of a substrate during surface layer formation is preferably approximately 150° C. or lower, and more preferably approximately 100° C. or lower. Even when the temperature of a substrate is approximately 100° C. or lower, a photosensitive layer may be damaged by heat if the layer is heated, under the influence of plasma, to higher than approximately 150° C. Therefore, it is preferable to set the temperature of a substrate with considering such influence.

The substrate temperature may be controlled by a method not shown in Figure, or by a natural increase in temperature during discharge. In order to heat the substrate 14, a heater may be provided out of the substrate 14 or inside of the substrate 14. In order to cool the substrate 14, cooling gas or liquid may be circulated inside of the substrate 14.

In order to avoid the heating of the substrate by discharge, it is effective to adjust the flow of the high-energy gas supplied onto the surface of the substrate 14. In this case, conditions such as the flow rate of gas, a discharge output, or a pressure may be adjusted so as to obtain the desired temperature.

When hydrogen gas is added to the surface layer, the hydrogen gas may be introduced from the gas inlet 15 or the gas-supply tube 20. In this case, the hydrogen gas may be introduced in a mixture with a gas containing a component essential to the formation of the surface layer such as nitrogen gas or trimethylgallium gas.

In order to control conductive type of the surface layer, a dopant may be added thereto. When a dopant is added during film formation, gaseous $SiH_4$ or $SnH_4$ may be used for an n-type surface layer, while gaseous biscyclopentadienylmagnesium, dimethylcalcium, dimethylstrontium, dimethylzinc, diethylzinc, or the like may be used for a p-type surface layer. A known method such as a thermal diffusion method or an ion injection method may be used for doping a dopant element into the surface layer.

Specifically, a surface layer having desired conductive type such as n-type or p-type may be obtained by introducing a gas containing at least one dopant element into the film-forming chamber 10 via the gas inlet 15 and the shower nozzle 16.

In the film-forming apparatus shown in FIG. 4, a high-frequency oscillator is used as a plasma-generating device, but is not limited thereto. The examples thereof include a microwave oscillator, an electrocyclotron resonance system, and a helicon plasma system. A high-frequency oscillator may be an induction or capacitance oscillator. These apparatuses may be used in combination of two or more, or similar apparatuses may be used in combination of two or more.

When two or more different plasma-generating devices (plasma-generating units) are used, the same pressure of discharge should be formed simultaneously. Differences in pressure may be formed in a discharged region and in a film-forming region (a region the substrate is provided). These devices may be arranged in series with respect to the gas flow ranging from a gas inlet to a gas outlet in the treatment device, or may be arranged so as to face the film-forming surface of a substrate.

For example, in the film-forming apparatus shown in FIG. 4, when two kinds of plasma-generating units are arranged in series with respect to the gas flow, one of the units may be used as a second plasma-generating device that may form discharge in the film-forming chamber 10 by using the shower nozzle 16 as the electrode. In such a case, discharge may be formed in the film-forming chamber 10 by using the shower nozzle 16 as the electrode and applying high-frequency voltage to the shower nozzle 16 via the gas inlet 15.

Alternatively instead of using the shower nozzle 16 as an electrode, by forming a cylindrical electrode between the substrate 14 and the plasma diffusion unit 17 in the film-forming chamber 10 and by utilizing the cylindrical electrode, discharge may be formed in the film-forming chamber 10.

When two different kinds of plasma-generating devices are used under the same pressure, using a microwave oscillator and a high-frequency oscillator is effective in controlling film quality since these devices may alter the excitation energy of excited species. The discharge may be conducted in the vicinity of the atmospheric pressure (from approximately 70,000 Pa to approximately 110,000 Pa).

Conductive Substrate and Photosensitive Layer

Hereinafter, with reference to a case in which an electrophotographic photoreceptor of an exemplary embodiment of the invention is used for an organic photoreceptor having a functionally separated photosensitive layer, a conductive substrate and photosensitive layer used to configure the electrophotographic photoreceptor of an exemplary embodiment of the invention, and an undercoat layer which may be provided as needed, will be described in detail.

Conductive Substrate

The examples of a conductive substrate include: a metal drum such as made of aluminum, copper, iron, stainless, zinc, or nickel; a metal such as aluminum, copper, gold, silver, platinum, palladium, titanium, nickel-chromium, stainless steel, or copper-indium deposited on a base material such as a sheet, a paper, a plastic, or a glass; a conductive metal compound such as indium oxide or tin oxide deposited on the above base material; a metal foil laminated on the above base material; and carbon black, indium oxide, tin oxide-antimony oxide powder, metal powder, copper iodide, or the like dispersed into a binder resin and applied on the above base material for conduction treatment. The shape of the conductive base substance may be any one of drum shape, sheet shape, and plate shape.

When a metallic pipe substrate is used as the conductive substrate, the surface of the metallic pipe substrate may be the original pipe as it is. However, it is also possible to roughen the surface of the substrate by a surface treatment in advance. When a coherent light source such as a laser beam is used as an exposure light source, the above surface roughening may prevent the uneven concentration in the grain form which may occur in the photoreceptor due to the coherent light. The methods of surface treatment include specular cutting, etching, anodization, rough cutting, centerless grinding, sandblast, wet honing and the like.

In particular, from the point of improving the adhesiveness with the photosensitive layer and improving the film-forming property, an aluminum substrate having an anodized surface thereon may be used as the conductive substrate.

A method of manufacturing the conductive substrate having the anodized surface is described below. First, as to the substrate, pure aluminum or aluminum alloy (for example, aluminum or aluminum alloy of number between 1000 and 1999, between 3000 and 3999, or between 6000 and 6999 defined in JIS H4080 (2006), which corresponds to ISO 6363-2 (1993), is prepared. Next, anodization is performed. The anodization is performed in an acid bath of such as chromic acid, sulfuric acid, oxalic acid, phosphoric acid, boric acid, or sulfamic acid. Treatment using a sulfuric acid bath is often used. The anodization can be performed, for example, under a condition of sulfuric acid concentration: from approximately 10 weight % to approximately 20 weight %; bath temperature: from approximately 5° C. to approximately 25° C.; current density: from approximately 1 $A/dm^2$ to approximately 4 $A/dm^2$; bath voltage: from approximately 5 V to approximately 30 V; and treatment time: approximately 5 minutes to approximately 60 minutes, while it is not limited thereto.

The anodized film formed on the aluminum substrate in this manner is porous and highly insulative, and has a very unstable surface. Therefore, after forming the film, the physical characteristics value is easily changed over time. In order to prevent the change in physical characteristics value, the anodized film is further subjected to sealing treatment. Example of the methods of sealing treatment include a method of soaking the anodized film in an aqueous solution containing nickel fluoride or nickel acetate, a method of soaking the anodized film in boiling water, and a method of treating by pressurized steam. Among these methods, the method of soaking in an aqueous solution containing nickel acetate is most often used.

On the surface of the anodized film that has been sealed in this manner, excessive metal salts and the like adhered by the sealing treatment remains thereon. When excessive metal salts and the like remains on the anodized film of the substrate, not only the quality of the coating film formed on the anodized film is adversely affected, but also low resistant components generally tend to remain. Therefore, if the above substrate is used as a photoreceptor to form an image, the substrate may contribute to the development of scumming.

Therefore, following the sealing treatment, washing treatment of the anodized film is performed in order to remove the excess metal salts and the like adhered by the sealing treatment. The washing treatment may be a one-time washing of the substrate, but multistep washing of the substrate may also be applied. When the multistep washing is applied, washing solution as clean as possible (deionized) is used for the last step. Furthermore, at any one step of the multistep washing, a physical rubbing washing using a contact member such as a brush may be performed.

The thickness of the anodized film on the surface of the conductive substrate formed as above is preferably in a range of from approximately 3 μm to approximately 15 μm. On the anodized film, a layer called a barrier layer is present along the porous shaped most outer surface of a porous anodized film. The thickness of the barrier layer of an exemplary embodiment of the invention is preferably in a range of from approximately 1 nm to approximately 100 nm in the photoreceptor. In the above manner, the anodized conductive substrate can be obtained.

In the conductive substrate obtained in this manner, the anodized film formed on the substrate by anodization has a high carrier blocking property. Therefore, when the photoreceptor using this conductive substrate is installed in the image forming apparatus and print off development (negative/positive development) is performed using the apparatus, occurring of point defects (black dots and scumming) may be prevented and current leak phenomenon from a contact electrification device which often occurs at the time of contact electrification may also be prevented. Moreover, by sealing the anodized film, the change of the physical characteristics value over time after forming the anodized film may be prevented, and by washing the conductive substrate after sealing treatment, the excess metal salts and the like adhered on the surface of the conductive substrate by sealing treatment may be removed. Therefore, if the image forming apparatus that includes a photoreceptor produced by using this conductive substrate is used to form an image, the development of scumming may be prevented.

Undercoat Layer

Hereinafter, an exemplary embodiment of an undercoat layer of the invention will be explained. Examples of a material forming the undercoat layer include: a polymeric resin compound such as an acetal resin (for example, polyvinyl butyral), a polyvinylalcohol resin, a casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol-formaldehyde resin, and a melamine resin; an organometallic compound such as a compound containing zirconium, titanium, aluminum, manganese, silicon atoms, or the like.

These compounds may be used singly, or two or more kinds thereof may be used as a mixed compound or as a polycondensation compound. Among them, an organometallic compound containing zirconium or an organometallic compound containing silicon are preferably used since such compounds have low residual potential, low potential change due to environment, and low potential change due to repetitive usage. The organometallic compounds may be used singly, or two or more kinds thereof may be used as a mixed compound, or may be used by being mixed with the above resin.

Examples of an organic silicon compound (organometallic compound containing silicon atoms) include vinyltrimethoxysilane, γ-methacryloxypropyl-tris (β-methoxyethoxy)silane, β-(3,4-epoxycyclohexyl)ethyltrimethoxysilane, γ-glycidoxypropyl trimethoxysilane, vinyltriacetoxysilane, γ-mercaptopropyl trimethoxysilane, γ-aminopropyltriethoxysilane, N-β-(aminoethyl)-γ-aminopropyltrimethoxysilane, N-β-(aminoethyl)-γ-aminopropyl methyldimethoxysilane, N,N-bis(β-hydroxyethyl)-γ-aminopropyl triethoxysilane, γ-chloropropyltrimethoxysilane, and the like. Among them, a silane coupling agent such as vinyltriethoxysilane, vinyl tris (2-methoxy ethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropyl methyldimethoxysilane, 3-aminopropyl triethoxysilane, N-phenyl-3-aminopropyltrimethoxysilane, 3-mercaptopropyltrimethoxysilane, or 3-chloropropyltrimethoxysilane is preferably used.

Examples of an organic zirconium compound (organometallic compound containing zirconium) include zirconium butoxide, ethyl zirconium acetoacetate, zirconium triethanolamine, acetylacetonato zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, and the like.

Examples of an organic titanium compound (organometallic compound containing titanium) include tetraisopropyl titanate, tetranormalbutyl titanate, butyl titanate dimer, tetra (2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, polyhydroxytitanium stearate, and the like.

Examples of an organic aluminum compound (organometallic compound containing aluminum) include aluminum isopropylate, monobutoxyaluminum diisopropylate, aluminum butyrate, ethylacetoacetate aluminum diisopropylate, aluminum tris(ethylacetoacetate), and the like.

Examples of a solvent for use in a coating liquid for forming an undercoat layer include a known organic solvent such as: an aromatic hydrocarbon solvent such as toluene or chlorobenzene; an aliphatic alcohol solvent such as methanol, ethanol, n-propanol, iso-propanol or n-butanol; a ketone solvent such as acetone, cyclohexanone, or 2-butanone; a halogenated aliphatic hydrocarbon solvent such as methylene chloride, chloroform, or ethylene chloride; a cyclic or linear ether solvent such as tetrahydrofuran, dioxane, ethylene glycol, diethylether; or an ester solvent such as methyl acetate, ethyl acetate, or n-butyl acetate. These solvents may be used singly, or two or more kinds thereof may be used in a mixture thereof. When two or more kinds thereof are used in a mixture, any solvent that can dissolve a binder resin therein may be used.

The undercoat layer is formed by applying the coating liquid for forming the undercoat layer, which is formulated by dispersing and mixing a coating agent for undercoat layer and a solvent, to the surface of the conductive substrate. As the method used for applying the coating liquid for forming the undercoat layer, a general method such as a dip coating method, a ring coating method, a wire bar coating method, a spray coating method, a blade coating method, a knife coating method, or a curtain coating method may be used. When the undercoat layer is formed, thickness of the formed layer is preferably in a range of from approximately 0.1 μm to approximately 3 μm. When the thickness of the undercoat layer is within the above range, potential increase due to desensitization or repetition may be prevented without overstrengthening the electrical barrier.

As a result of forming the undercoat layer on the conductive substrate in this manner, it is possible to improve wettability with respect to coating formation of a layer to be formed on the undercoat layer, and the undercoat layer also may function as an electrical blocking layer.

The surface roughness of the undercoat layer formed by the above manner may be adjusted so as to have a roughness of within a range of from about 1 to about 1/(4 n) times the laser wavelength λ for exposure to be used (where n represents the refractive index of a layer provided on the periphery of the undercoat layer). The surface roughness of the undercoat layer is adjusted by adding resin particles into the coating liquid for forming the undercoat layer. When the photoreceptor formed by adjusting the surface roughness of the undercoat layer is used for an image forming apparatus, interference fringes due to the laser source may be sufficiently prevented. As the resin particles, silicone resin particles, crosslinked PMMA (poly(methyl methacrylate) resin particles, or the like may be used. Alternatively, the surface of the undercoat layer may be ground for adjusting the surface roughness. As the grinding method, buffing, sandblasting, wet honing, grinding treatment, or the like may be used. In the photoreceptor used for the image forming apparatus having positive electrification configuration, laser incident beams are absorbed in the vicinity of the most outer surface of the photoreceptor, and are further scattered in the photosensitive layer. Therefore, adjusting the surface roughness of the undercoat layer is not strongly needed.

In order to improve electric properties, environmental safety, and the quality of image, it is preferable to add various types of additives to the coating liquid for forming the undercoat layer. Examples of the additives include: an electron transport substance that includes a quinone-based compound such as chloranyl, bromoanil, or anthraquinone, a tetracyanoquinodimethane compound, a fluorenone compound such as 2,4,7-trinitrofluorenone or 2,4,5,7-tetranitro-9-fluorenone, an oxadiazol compound such as 2-(4-biphenyl)-5-(4-t-butylphenyl)-1,3,4-oxadiazole, 2,5-bis(4-naphthyl)-1,3,4-oxadiazole, or 2,5-bis(4-diethyl aminophenyl) 1,3,4 oxadiazole, a xanthone compound, a thiophene compound, and a diphenoquinone compound such as 3,3',5,5'-tetra-t-butyldiphenoquinone; an electron transport pigment such as polycyclic condensates or azos; and a known material such as a zirconium chelate compound, a titanium chelate compound, an aluminum chelate compound, a titanium alkoxide compound, an organic titanium compound, or a silane coupling agent.

Examples of the silane coupling agent used here are not specifically limited but include silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, or γ-chloropropyltrimethoxysilane.

Specific examples of the zirconium chelate compound include zirconium butoxide, zirconium ethyl acetoacetate, zirconium triethanolamine, acetylacetonate zirconium butoxide, ethyl acetoacetatezirconium butoxide, zirconium acetate, zirconium oxalate, zirconium lactate, zirconium phosphate, zirconium octanoate, zirconium naphthenate, zirconium laurate, zirconium stearate, zirconium isostearate, methacrylate zirconium butoxide, stearate zirconium butoxide, and isostearate zirconium butoxide.

Specific examples of the titanium chelate compound include tetraisopropyl titanate, tetranormalbutyl titanate, butyl titanate dimer, tetra(2-ethylhexyl) titanate, titaniumacetylacetonate, polytitaniumacetylacetonate, titanium octylene glycolate, titanium lactate ammonium salt, titanium lactate, titanium lactate ethyl ester, titanium triethanolaminate and polyhydroxytitanium stearate.

Specific examples of the aluminum chelate compound include aluminum isopropylate, monobutoxyaluminum diisopropylate, aluminum butyrate, ethylacetoacetate aluminum diisopropylate and aluminum tris(ethylacetoacetate).

These additives may be used singly, or two or more kinds thereof may be used as a mixed compound or as a polycondensation compound.

The above coating liquid for forming the undercoat layer may contain at least one type of electron accepting material. Specific examples of the electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these materials, fluorenones, quinones, and benzene compounds having an electron attractive substituent such as Cl, CN, and $NO_2$ are preferably used. By using these materials, in the photosensitive layer, the photosensitivity may be improved, the residual potential may be decreased and deterioration of photosensitivity caused by repeated use may be reduced. Uneven concentration of the toner image, which is formed by the image forming apparatus including the above photoreceptor containing an electron accepting material in the undercoat layer, may be sufficiently prevented.

Instead of using the above coating agent for undercoat layer, a dispersion type coating agent for undercoat layer described below is preferably used. By using the dispersion type coating agent, the resistance of the undercoat layer may be appropriately adjusted, and thereby accumulation of residual charge may be prevented and the undercoat layer may be made thicker. Therefore, the leak resistance of the photoreceptor may be improved, and leaking at the time of contact electrification may be particularly prevented.

Examples of the dispersion type coating agent for undercoat layer include a material dispersed in a binder resin, and the material includes: metal powder such as aluminum, copper, nickel, or silver; conductive metal oxide such as antimony oxide, indium oxide, tin oxide, or zinc oxide; and conductive material such as a carbon fiber, a carbon black, or a graphite powder. The conductive metal oxide is preferably a metal oxide particle having an average primary particle diameter of approximately 0.5 μm or less. When the average primary particle diameter is too large, a local electrically-conducting path is often generated and current leaking is easily occurred, which may result in the occurrence of fogging or leaking of large current from a charging unit. The undercoat layer is needed to be adjusted to an appropriate resistance in order to improve the leak resistance. Therefore, the above metal oxide particle preferably have a powder resistivity of from about $10^2\Omega\cdot$cm to about $10^{11}\Omega\cdot$cm.

When the resistivity of the metal oxide particle is lower than the lower limit of the above range, sufficient leak resistance may not be obtained. When the resistivity is higher than the upper limit of the above range, the residual potential may be increased. Therefore, among these metal oxide particles, stannic oxide, titanium oxide, and zinc oxide are preferably used. Two or more kinds of the metal oxide particles may be used in a mixture thereof. Furthermore, by treating the surface of the metal oxide particles with a coupling agent, the powder resistivity of the metal oxide particles may be easily controlled. For the coupling agent, similar materials applied for the above coating liquid for forming the undercoat layer can be used. Two or more kinds of the coupling agents may be used in a mixture thereof.

Any known method may be used for surface treatment of the metal oxide particles, and both dry and wet methods are used favorably.

In the dry method, firstly water adsorbed on the surface of the metal oxide particles is removed by heating. By removing the surface-adsorbed water, the coupling agent may be evenly adsorbed on the surface of the metal oxide particles. Then, while stirring the metal oxide particles by a mixer or the like having a large shearing force, the coupling agent, either directly or dissolved in an organic solvent or water, is dropped or sprayed with dry air or nitrogen gas, and thereby the treatment is evenly performed. When the coupling agent is dropped or sprayed, the treatment may be performed at a temperature of approximately 50° C. or higher. After addition or spraying the coupling agent, the particles are preferably baked at a temperature of approximately 100° C. or higher. The baking may lead to hardening of the coupling agent and also tight adhesion to the metal oxide particles in chemical reaction. The particles may be baked at a temperature for any period, if desired electrophotographic characteristics are obtained.

In the wet method, the surface-adsorbed water on the metal oxide particles is first removed by the similar method used in the dry method. The surface-adsorbed water may be removed, for example, by drying under heat as in the dry method, stirring under heat in a solvent for surface treatment, or azeotroping the surface-adsorbed water. The metal oxide particles are then stirred in a solvent, and dispersed by using ultrasonic waves, a sandmill, an attritor, a ball mill, or the like. The coupling agent solution is added thereinto, and stirred or dispersed. Then, the solvent is removed, and thereby the surface treatment is evenly performed. After removing the solvent, the mixture is baked additionally at approximately 100° C. or higher. The particles may be baked at a temperature for any period, if desired electrophotographic characteristics are obtained.

The surface-treating agent should be added to the metal oxide fine particles in an amount sufficient for giving desired electrophotographic characteristics. The electrophotographic characteristics are influenced by the amount of the surface-treating agent remaining on the metal oxide particles after surface treatment. The adhesion amount of silane-coupling agent is determined on the basis of the Si intensity (due to Si in silane-coupling agent) as determined by fluorescent X-ray analysis and the intensity of the main metal element used in the metal oxide. The Si intensity, as determined by fluorescent X-ray analysis, is preferably in a range of from approximately $1.01\times10^{-5}$ times to approximately $1.0\times10^{-3}$ times of the intensity of the main metal element used. When the intensity is below the range, image defects such as blushing may often occur. When the intensity is above the range, deterioration in density due to increase in residual potential may be caused.

Examples of the binder resin contained in the dispersion type coating agent for undercoat layer include a known polymeric resin compound such as an acetal resin (for example, polyvinyl butyral), a polyvinylalcohol resin, a casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, or an urethane resin; a charge transport resin having a charge transport group; and a conductive resin such as polyaniline.

Among these resins, a resin that insoluble in a coating solvent for a layer formed on the undercoat layer may be preferably used. In particular, a phenol resin, a phenol-formaldehyde resin, a melamine resin, an urethane resin, an epoxy resin, and the like are preferably used. The ratio of the metal oxide particles to the binder resin in the dispersion type coating liquid for forming the undercoat layer may be arbitrarily set within a range by which a desired photoreceptor characteristic may be obtained.

The metal oxide particles surface-treated by the method described above is dispersed in the binder resin, for example, by a method of using a media disperser such as a ball mill, a vibratory ball mill, an attritor, a sandmill, or a horizontal sandmill, and a medialess disperser such as an agitator, an ultrasonic disperser, a roll mill, or a high pressure homogenizer. The high-pressure homogenizers include a collision-type homogenizer further dispersing the crude dispersion by liquid-liquid collision or liquid-wall collision under high pressure and a penetration-type homogenizer dispersing liquid by passage through fine channels under high pressure, and the like.

The undercoat layer is formed with the dispersion type coating agent for undercoat layer, according to a method similar to that of forming an undercoat layer by using a coating agent for undercoat layer described above.

Photosensitive Layer: Charge Transport Layer

Hereinafter, the charge transport layer and the charge generation layer in photosensitive layer will be described in this order.

Examples of the charge transport material used for the charge transport layer include a hole transport material such as: oxadiazoles such as 2,5-bis(p-diethylaminophenyl)-1,3,4-oxadiazole; pyrazolines such as 1,3,5-triphenyl-pyrazoline, or 1-[pyridyl-(2)]-3-(p-diethylaminostyryl)-5-(p-diethylaminostyryl)pyrazoline; an aromatic tertiary amino compound such as triphenylamine, tri(p-methyl)phenylamine, N,N-bis(3,4-dimethylphenyl)biphenyl-4-amine, dibenzylaniline, or 9,9-dimethyl-N,N-di(p-tolyl) fluorenone-2-amine; an aromatic tertiary diamino compound such as N,N'-diphenyl-N,N'-bis(3-methylphenyl)-[1,1-biphenyl]-4,4'-diamine; 1,2,4-triazines such as 3-(4'dimethylaminophenyl)-5,6-di-(4'-methoxyphenyl)-1,2,4-triazine; hydrazones such as 4-diethylaminobenzaldehyde-1,1-diphenylhydrazone, 4-diphenylaminobenzaldehyde-1,1-diphenylhydrazone, [p-(diethylamino)phenyl](1-naphthyl)phenylhydrazone, 1-pyrenediphenylhydrazone, 9-ethyl-3-[(2-methyl-1-indolinylimino)methyl]carbazole, 4-(2-methyl-1-indolinyliminomethyl)triphenylamine, 9-methyl-1-carbazolediphenylhydrazone, 1,1-di-(4,4'-methoxyphenyl) acrylaldehydediphenylhydrazone, or β,β-bis (methoxyphenyl) vinyldiphenylhydrazone; quinazolines such as 2-phenyl-4-styryl-quinazoline; benzofurans such as 6-hydroxy-2,3-di(p-methoxyphenyl)-benzofuran; α-stilbenes such as p-(2,2-diphenylvinyl)-N,N-diphenylaniline; enamines; carbazoles such as N-ethylcarbazole; poly-N-vinylcarbazole or the modified compounds thereof. Examples thereof further include a polymer having a group including any of the above compounds on the main chain or side chain. These charge transport materials may be used singly, or two or more kinds thereof may be used in combination.

Any resin may be used as the binder resin for use in the charge transport layer. However, the binder resin is preferably a resin having an appropriate strength and a compatibility with the charge transport materials.

Examples of the binder resin include: various polycarbonate resins containing bisphenol A, bisphenol Z, bisphenol C, bisphenol TP, or the like, and the copolymer thereof; a polyalylate resin and the copolymer thereof; a polyester resin; a methacrylic resin; an acrylic resin; a polyvinylchloride resin; a polyvinylidene chloride resin; a polystyrene resin; a polyvinyl acetate resin; a styrene-butadiene copolymer resin; a vinyl chloride-vinyl acetate copolymer resin; a vinyl chloride-vinyl acetate-maleic anhydride copolymer resin; a silicone resin; a silicone-alkyd resin; a phenol-formaldehyde resin; a styrene-acrylic copolymer resin, an styrene-alkyd resin; a poly-N-vinylcarbazole resin; a polyvinyl butyral resin; and a polyphenylene ether resin. These resins may be used singly, or two or more kinds thereof may be used is a mixture.

The molecular weight of the binder resin for use in the charge transport layer may be selected properly according to the film-forming conditions such as the thickness of the photosensitive layer and the kind of solvent, however normally, the viscosity-average molecular weight of the binder resin is preferably in a range of from approximately 3,000 to approximately 300,000 and more preferably from approximately 20,000 to approximately 200,000.

The charge transport layer can be formed by coating and drying a solution containing the charge transport material and the binder resin dissolved in a suitable solvent. Examples of the solvents for use in the solution for forming the charge transport layer include aromatic hydrocarbons such as benzene, toluene, or chlorobenzene; ketones such as acetone or 2-butanone; halogenated aliphatic hydrocarbons such as methylene chloride, chloroform, or ethylene chloride; cyclic or straight-chain ethers such as tetrahydrofuran, dioxane, ethylene glycol, or diethylether; the mixed solvent thereof; and the like. The blending ratio of the charge transport material to the binder resin is preferably in a range of from approximately 10:1 to approximately 1:5. The thickness of the charge transport layer is generally, preferably in the range of from approximately 5 μm to approximately 50 μm, more preferably in the range of approximately 10 μm to approximately 40 μm.

The charge transport layer and/or the charge generation layer described below may contain additives such as an antioxidant, a photostabilizer, or a heat stabilizer, in order to prevent the degradation of the photoreceptor by the ozone or oxidative gases generated in the image-forming apparatus, heat, or light.

Examples of the antioxidants include hindered phenols, hindered amines, p-phenylenediamine, arylalkanes, hydroquinone, spirochromane, spiroindanone or modified compounds thereof, organic sulfur compounds, organic phosphorus compounds, and the like.

Specific examples of the antioxidant compounds include phenolic antioxidants such as 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butyl-phenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxyphenyl) propionate]-methane, 3,9-bis[2-[3-(3-t-butyl-4-hydroxy-5-methylphenyl)propionyloxy]-1,1-dimethylethyl]-2,4,8,10-tetraoxaspiro[5,5]undecane, stearyl 3-(3',5'-di-t-butyl-4'-hydroxyphenyl)propionate or the like Examples of hindered amines includes bis(2,2,6,6-tetramethyl-4-pyperidyl)sebacate, bis(1,2,2,6,6-pentamethyl-4-pyperidyl)sebacate, 1-[2-[3-(3,5-di-t-butyl-4-hydroxyphenyl) propionyloxy]ethyl]-4-[3-(3,5-di-t-butyl-4-hydroxyphenyl) propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazin-2,4-diyl}{(2,2,6,6-tetramethyl-4-pyperidyl)imino}hexamethylene {(2,3,66-tetramethyl-4-pyperidyl)imino}], 2-(3,5-di-t-butyl-4-hydroxybenzyl)-2-n-butyl bis malonic acid bis(1,2,2,6,6-pentamethyl-4-pyperidyl), N,N'-bis(3-aminopropyl) ethylenediamine-2,4-bis[N-butyl-N-(1,2,2,6,6-pentamethyl-4-piperidyl)amino]-6-chloro-1,3,5-triazine condensate, and the like.

Examples of organic sulfur antioxidants include dilauryl-3,3'-thiodipropionate, dimyristoyl-3,3'-thiodipropionate, distearyl-3,3'-thiodipropionate, pentaerythritol-tetrakis-(β-lauryl-thiopropionate), ditridecyl-3,3'-thiodipropionate, 2-mercaptobenzimidazole, and the like.

Examples of organic phosphorus antioxidants include tris-nonylphenyl phosphite, triphenyl phosphite, tris(2,4-di-t-butylphenyl)-phosphite, and the like.

The organic sulfur- and phosphorus-antioxidants are called secondary antioxidants, and may improve anti-oxidative effect synergistically in combination with a phenol- or amine-containing primary antioxidant.

Examples of the photostabilizers include modified compounds of benzophenone, benzotriazole, dithiocarbamate, and tetramethylpiperidine, and the like.

Examples of the benzophenone photostabilizers include 2-hydroxy-4-methoxybenzophenone, 2-hydroxy-4-octoxybenzophenone, 2,2'-di-hydroxy-4-methoxybenzophenone, and the like.

Examples of the benzotriazole photostabilizers include 2-(2'-hydroxy-5'-methylphenyl)-benzotriazole, 2-[2'-hydroxy-3'-(3",4",5",6"-tetrahydrophthalimide-methyl)-5'-methylphenyl]-benzotriazole, 2-(2'-hydroxy-3-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)-benzotriazole, 2-(2'-hydroxy-5'-t-octylphenyl]-benzotriazole, 2-(2'-hydroxy-3',5'-di-t-amylphenyl)-benzotriazole, and the like.

Examples of other photostabilizers include 2,4-di-t-butylphenyl-3',5'-di-t-butyl-4'-hydroxybenzoate, nickel dibutyl-dithiocarbamate, and the like.

The charge transport layer may be formed by coating and drying a solution containing the charge transport material and the binder resin dissolved in a suitable solvent. Examples of the solvents used for preparing the coating solution for forming the charge transport layer include: an aromatic hydrocarbons solvent such as benzene, toluene, or chlorobenzene; a ketones solvent such as acetone or 2-butanone; a halogenated aliphatic hydrocarbons solvent such as methylene chloride, chloroform, or ethylene chloride; cyclic or straight-chain ether solvents such as tetrahydrofuran, dioxane, ethylene glycol, or diethylether; and the mixed solvents thereof.

In the coating solution for forming the charge transport layer, as a leveling agent for improving the smoothness of the coated film, a trace amount of silicone oil may be added.

The blending ratio of the charge transport material to the binder resin is preferably from approximately 10:1 to approximately 1:5 by weight. The thickness of the charge transport layer is generally, preferably in the range of from approximately 5 μm to approximately 50 μm, and more preferably in the range of from approximately 10 μm to approximately 30 μm.

The coating solution for forming the charge transport layer may be applied by dip coating, ring coating, spray coating, bead coating, blade coating, roller coating, knife coating, curtain coating, or the like, according to the shape and application of the photoreceptor. The coated film is preferably dried first at room temperature and then under heat. The coated film is preferably dried in a temperature range of from approximately 30° C. to approximately 200° C. for a period in the range of from approximately 5 minutes to approximately 2 hours.

Photosensitive Layer; Charge Generation Layer

The charge generation layer is formed by depositing a charge generation material by using a vacuum deposition method or by coating a solution thereof containing an organic solvent and a binder resin additionally.

Examples of the charge generation materials include selenium compounds such as an amorphous selenium, a crystalline selenium, a selenium-tellurium alloy, or a selenium-arsenic alloy; inorganic photoconductors such as a selenium alloy, zinc oxide, or titanium oxide, or those sensitizable with a colorant; various phthalocyanine compounds such as metal free phthalocyanine, titanyl phthalocyanine, copper phthalocyanine, tin phthalocyanine, or gallium phthalocyanine; various organic pigments such as squarylium pigment, anthanthrone pigment, perylene pigment, azo pigment, anthraquinone pigment, pyrene pigment, pyrylium salt, or thiopyrylium salt; and dyes.

These organic pigments generally have several crystal forms, and in particular, phthalocyanine compounds are known to have many crystal forms including α and β, however any crystal form may be used, if the pigment gives suitable sensitivity and other characteristics.

Among the above charge generation materials, phthalocyanine compounds are preferably used. When the photosensitive layer is irradiated with light, the phthalocyanine compounds contained in the photosensitive layer absorb the photon and generate a carrier. Due to the phthalocyanine compounds having a high quantum efficiency, the photon is efficiently absorbed and the carrier is generated.

Among the above phthalocyanine compounds used as the charge generation materials, phthalocyanines indicated in the following items (1) to (3) are more preferable:

(1) crystalline hydroxygallium phthalocyanine having diffraction peaks at least at positions of 7.6°, 10.0°, 25.2°, and 28.0° in Bragg angles (2θ±0.2°) of an X-ray diffraction spectrum obtained using a CuKα ray;

(2) crystalline chlorogallium phthalocyanine having diffraction peaks at least at positions of 7.3°, 16.5°, 25.4°, and 28.1° in Bragg angles (2θ±0.2°) of an X-ray diffraction spectrum obtained using a CuKα ray; and (3) crystalline titanyl phthalocyanine having diffraction peaks at least at positions of 9.5°, 24.2°, and 27.3° in Bragg angles (2θ±0.2°) of an X-ray diffraction spectrum obtained using a CuKα ray.

Due to high and stable photosensitivity of these phthalocyanine compounds, a photoreceptors having a photosensitive layer containing the phthalocyanine compound may be suitable for use in a photoreceptor for color image-forming apparatus which requires high-speed image formation and repetition reproducibility.

Although the peak intensity and the diffraction angle thereof may deviate slightly from the above value according to the crystal shape and measuring method, the crystal having essentially-consistent X-ray diffraction patterns may be regarded as having the same crystal form.

The binder resins for use in the charge generation layer include polycarbonate resins such as bisphenol A or bisphenol Z and the copolymers thereof, polyarylate resins, polyester resins, methacrylic resins, acrylic resins, polyvinyl chloride resins, polystyrene resins, polyvinyl acetate resins, styrene-butadiene resin copolymers, vinylidene chloride-acrylonitrile resin copolymers, vinyl chloride-vinyl acetate-maleic anhydride resins, silicone resins, silicon-alkyd resins, phenol-formaldehyde resins, styrene-alkyd resins, poly-N-vinylcarbazole, and the like.

These binder resins may be used singly, or two or more kinds thereof may be used in combination. The blending ratio of the charge generation materials to the binder resin (charge generation material: binder resin) is preferably in a range of from approximately 10:1 to approximately 1:10 by weight. The thickness of the charge generation layer is generally, preferably in a range of from approximately 0.01 μm to approximately 5 μm, and more preferably in a range of from approximately 0.05 μm to approximately 2.0 μm.

For improving the sensitivity, reducing the residual potential, and preventing the fatigue after repeated use, the charge generation layer may contain at least one electron-accepting compound. Examples of the electron-accepting compound for use in the charge generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these compounds, fluorenone compounds, quinone compounds and benzene compounds having an electron-withdrawing substituent group such as Cl, CN, or $NO_2$ are particularly preferable.

The charge generation materials is dispersed in resin, for example, by using a roll mill, a ball mill, a vibration ball mill, an attritor, a dyno mill, a sand mill, a colloid mill, or the like.

Examples of the solvent for use in the coating solution for forming the charge generation layer include known organic solvents, for example, an aromatic hydrocarbons solvent such as toluene or chlorobenzene; an aliphatic alcohols solvent such as methanol, ethanol, n-propanol, iso-propanol, or n-butanol; a ketones solvent such as acetone, cyclohexanone, or 2-butanone; halogenated aliphatic hydrocarbon solvents such as methylene chloride, chloroform, or ethylene chloride;

cyclic or straight-chain ether solvents such as tetrahydrofuran, dioxane, ethylene glycol, or diethylether; ester solvents such as methyl acetate, ethyl acetate, or n-butyl acetate; and the like.

These solvents may be used singly or two or more kinds thereof may be used in a mixture thereof. When two or more kinds of solvents are used in a mixture, any solvent that can dissolve the binder resin when in a mixed solvent may be used. However, when the photosensitive layer has a configuration in which a charge transport layer and a charge generation layer are formed from the conductive substrate side in this order, if a charge-generating layer is formed by an application method that easily dissolves the lower layer such as dip coating, a solvent that hardly dissolves the lower layer, for example, the charge transport layer, may be preferably used. If the charge generation layer is formed by spray coating or ring coating, which is relatively less penetrative of the lower layer, the solvent may be selected from a wide range of solvents.

Process Cartridge and Image-Forming Apparatus

Hereinafter, exemplary embodiments of the process cartridge and the image-forming apparatus using the photoreceptor of the invention will be described.

The process cartridge of the exemplary embodiment of the invention is not particularly limited, if the process cartridge is detachably attached to a main body of an image forming apparatus and uses the photoreceptor of the invention. Specifically, a process cartridge including the photoreceptor of the exemplary embodiment of the invention integrated with at least one unit selected from the group consisting of a charging unit, a developing unit, a cleaning unit, and an antistatic unit, and having a unit which is detachably attached to the main body of the image forming apparatus, is preferable.

The image-forming apparatus of the exemplary embodiment of the invention is not particularly limited, if uses the photoreceptor of the exemplary embodiment of the invention. Specifically, the image-forming apparatus of the exemplary embodiment of the invention preferably include the photoreceptor of the exemplary embodiment of the invention, a charging unit for charging a photoreceptor surface, an electrostatic latent image forming unit for forming an electrostatic latent image by photoirradiating the photoreceptor surface charged by the charging unit, a developing unit for forming a toner image by developing the electrostatic latent image with a toner-containing developer, a transfer unit for transferring the toner image onto a recording medium, a fixing unit for fixing the toner image onto the recording medium, and a cleaning unit for cleaning the photoreceptor surface after transferring the toner image onto the recording medium. The image-forming apparatus of the exemplary embodiment of the invention may be a so-called tandem apparatus having multiple photoreceptors corresponding to the respective toners for various colors. In this case, all photoreceptors are preferably the photoreceptors of the exemplary embodiment of the invention. The image-forming apparatus of the exemplary embodiment of the invention may include an intermediate transfer medium such as an intermediate transfer belt or intermediate transfer drum. In this case, a toner image is transferred temporarily from a photoreceptor surface onto a surface of the intermediate transfer medium, and then transferred onto a recording medium.

In the photoreceptor of the exemplary embodiment of the present invention, generation of uneven surface potential at the surface of the photoreceptor after exposure may be easily suppressed, even when the surface is locally abraded. Accordingly, even if the image forming apparatus is used in an embodiment in which localized abrasion of the surface of the photoreceptor is apt to arise (namely, a configuration in which members that contact the photoreceptor are disposed at the periphery thereof; or in which a developer which tends to cause abrasion of the photoreceptor is used, or the like), uneven surface potential generated at the surface of the photoreceptor after exposure may be easily suppressed. From this viewpoint, it is preferable to use a charging roll as a charging unit, and to use a cleaning blade as a cleaning unit. Further, it is also preferable to use an intermediate transfer medium. Furthermore, in a toner component of a developer, it is preferable to use hard particles with a highly abrasive function such as silica or cerium oxide as an external additive.

Figure 7:
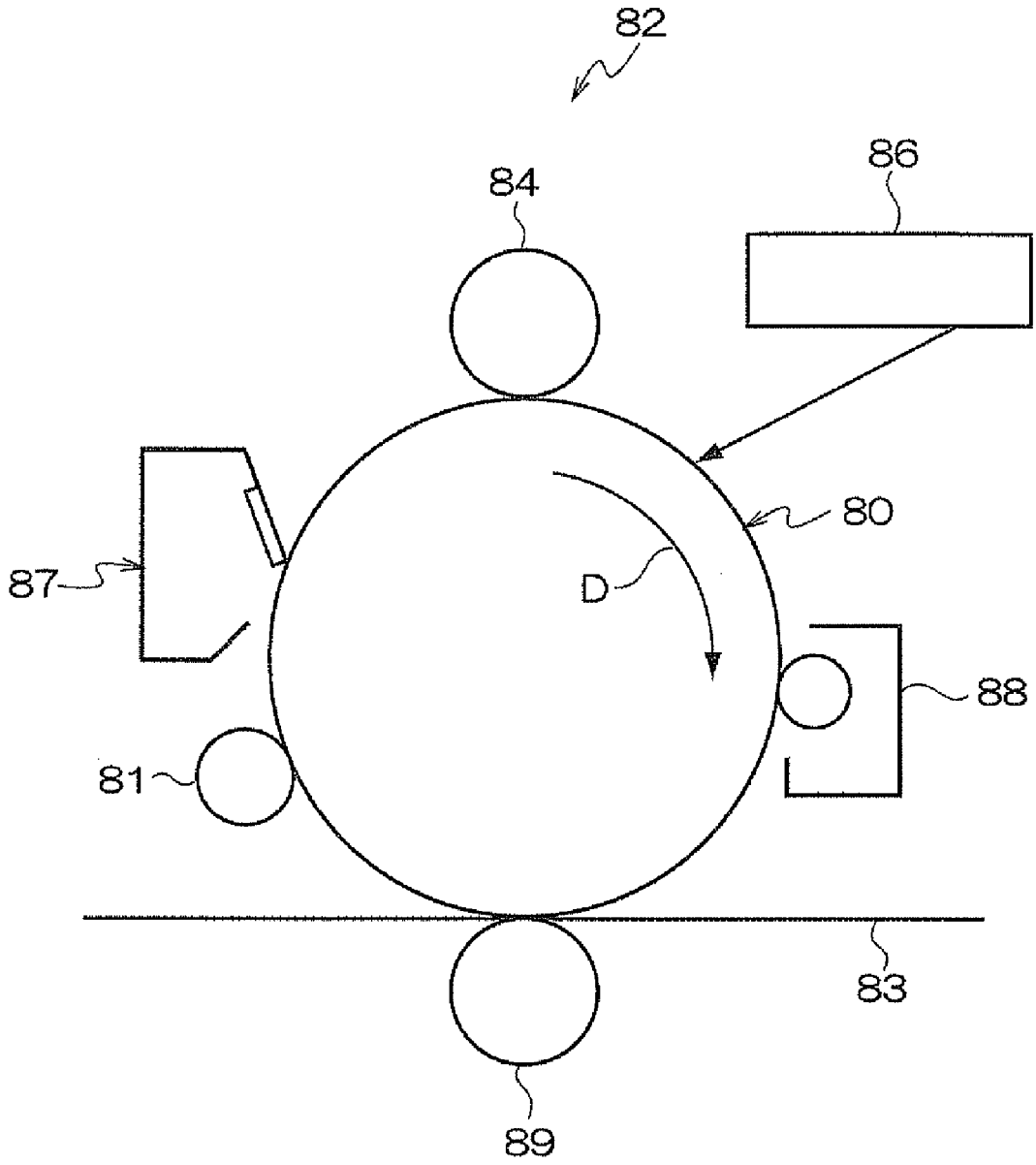
FIG. 7 is a schematic configuration diagram illustrating an example of an image forming apparatus of an exemplary embodiment of the invention.

Hereinafter, exemplary embodiments of the image forming apparatus of the invention will be described in detail with reference to drawings. FIG. 7 is a schematic configuration diagram illustrating an example of the film-forming apparatus.

As shown in FIG. 7, an image forming apparatus 82 of the exemplary embodiment of the invention is provided with an electrophotographic photoreceptor 80 that rotates in a predetermined direction (the direction D of the arrow in FIG. 7). A charging roll (charging unit) 84, an exposing unit 86, a developing unit 88, a transferring unit 89, an erasing unit 81, and a cleaning unit 87 are formed along the rotation direction of the electrophotographic photoreceptor 80 in the vicinity of the electrophotographic photoreceptor 80.

The charging roll 84 electrically charges the surface of the electrophotographic photoreceptor 80 so that the surface has a predetermined potential. The exposing unit 86 exposes the surface of the electrophotographic photoreceptor 80 that is electrically charged by the charging roll 84 to form an electrostatic latent image according to image data. The developing unit 88 stores a developer containing the toner for developing the electrostatic latent image, and supplies the stored developer onto the surface of the electrophotographic photoreceptor 80 to develop the electrostatic latent image, thereby forming a toner image.

By sandwiching a recording medium 83 between the electrophotographic photoreceptor 80 and the transferring unit 89, the transferring unit 89 transfers the toner image formed on the electrophotographic photoreceptor 80 onto the recording medium 83. The toner image that is transferred onto the recording medium 83 is fixed to the surface of the recording medium 83 using a fixing unit now shown in Figure.

The erasing unit 81 removes electricity from the substance that is attached to the surface of the electrophotographic photoreceptor 80 and electrically charged. The cleaning member 87 has a cleaning blade that is provided to come into contact with the surface of the electrophotographic photoreceptor 80, and removes the substance attached to the surface by utilizing the friction force between the surface of the electrophotographic photoreceptor 80 and the cleaning blade.

In the exemplary embodiment shown in FIG. 7, the units (process cartridge) including the photoreceptor 80 integrated with at least one unit selected from the group consisting of the charging unit 84, the developing unit 88, the cleaning unit 87, and an antistatic unit 81 may be detachably attached to the main body of the image forming apparatus 82.

Light Receiving Element

Further, the photoreceptor of an exemplary embodiment of the present invention may also be used as a light receiving element in addition to use in electrophotography. In this case, it is preferable to use the photoreceptor in an embodiment in which a surface layer thereof is subjected to abrasion. Furthermore, the photosensitive layer does not need to have a configuration specially adapted for use in electrophotography as described above.

EXAMPLES

Hereinafter, the invention will be described specifically with reference to Examples, while it should be understood that the invention is not limited to these Examples.

Preparation of Photoreceptor A1

Formation of Undercoat Layer

One hundred parts by weight of zinc oxide (average particle diameter: 70 nm, prototype manufactured by Tayca Corporation) are mixed with 500 parts by weight of toluene under stirring. To the mixture, 1.5 parts by weight of a silane coupling agent (trade name: KBM603, manufactured by Shin-Etsu Chemical Co., Ltd.) are added and stirred for 2 hours. Subsequently, toluene is removed by distillation under reduced pressure, and baking is conducted at a temperature of 150° C. for 2 hours.

Twenty-five parts by weight of methyl ethyl ketone is mixed to a solution prepared by dissolving: 60 parts by weight of zinc oxide which has been subjected to the above surface treatment; 15 parts by weight of a curing agent (blocked isocyanate, trade name: SUMIDUR BL3175, manufactured by Sumika Bayer Urethane Co., Ltd.); and 38 parts by weight of solution in which 15 parts by weight of butyral resin (trade name: S-LEC BM-1, manufactured by Sekisui Chemical Co., Ltd.) are dissolved in 85 parts by weight of methyl ethyl ketone, and a liquid to be treated is obtained.

Then, using a horizontal media mill disperser (KDL-PILOT type, trade name: DYNO-MILL, manufactured by Shinmaru Enterprises Corporation), dispersion treatment is performed in the following procedures. The cylinder and stirring mill of the above disperser are composed of ceramics including zirconia as a main component. Into the cylinder, glass beads having 1 mm of diameter (trade name: Hi-Bea D20, manufactured by Ohara Inc.) are charged in a bulk filling factor 80 volume %, followed by dispersion treatment in a circulation system at a peripheral speed of the stirring mill of 8 m/min and at a flow rate of the liquid to be treated of 1000 mL/min. A magnet gear pump is used for sending the liquid to be treated.

In the above dispersion treatment, a part of the liquid to be treated is sampled after a specified elapsed time, and the transmittance at the time of film formation is measured. That is, the liquid to be treated is applied to a glass plate so that it might have a thickness of 20 μm, and a coating is formed by performing curing treatment at a temperature of 150° C. for 2 hours. Thereafter, the transmittance at a wavelength of 950 nm is measured using a spectrophotometer (trade name: U-2000, manufactured by Hitachi, Ltd.). The dispersion treatment is completed when the transmittance (value at a coating thickness of 20 μm) exceeds 70%.

A coating liquid for forming an undercoat layer is prepared by adding 0.005 parts by weight of dioctyltin dilaurate as a catalyst and 0.01 parts by weight of silicone oil (trade name: SH29PA, manufactured by Dow Corning Toray Silicone Co., Ltd.) to the dispersion liquid obtained by the above method. The obtained coating liquid is applied by dip coating to an aluminum substrate having a diameter of 30 mm, a length of 404 mm and a thickness of 1 mm, followed by dry hardening at a temperature of 160° C. for 100 minutes, whereby an undercoat layer having a thickness of 20 μm is formed.

Formation of Photosensitive Layer

A mixture including: 15 parts by weight of crystal form chlorogallium phthalocyanine, which has diffraction peaks at least in the positions of 7.4°, 16.6°, 25.5°, and 28.3° in the Bragg angle (2θ±0.2°) of an X-ray diffraction spectrum using Cukα ray, as a charge generating material; 10 parts by weight of vinyl chloride-vinyl acetate copolymer resin (trade name: VMCH, manufactured by Nippon Unicar Co., Ltd.) as a binder resin; and 300 parts by weight of n-butyl alcohol, is subjected to a dispersion treatment for 4 hours in a sand mill using glass beads having a diameter of 1 mm, whereby a coating liquid for forming a charge transport layer is obtained. The obtained dispersed coating liquid is applied onto the undercoat layer by dip coating and then dried, whereby a charge generation layer having a thickness of 0.2 μm is formed.

Further, 4 parts by weight of N,N-diphenyl-N,N'-bis(3-methylphenyl)-[1,1']biphenyl-4,4'-diamine and 6 parts by weight of bisphenol Z polycarbonate resin (viscosity-average molecular weight: 40000) are added to 80 parts by weight of chlorobenzene and dissolved, whereby a coating liquid for forming a charge transport layer is obtained. The obtained coating liquid is applied to the charge generation layer and then dried at a temperature of 130° C. for 40 min to form a charge transport layer having a thickness of 25 μm, whereby an organic photoreceptor (non-coated photoreceptor) is obtained. Here, as a sample for measuring the refractive index of the organic photosensitive layer, an aluminum-deposited polyethylene terephthalate film (trade name: METALMY S (#25), manufactured by Toray Industries Inc.) with surface dimensions of 10 mm×10 mm, is adhered onto a drum with adhesive tape and, in a similar manner, a reference sample of an organic photosensitive layer coated with a charge transport layer is prepared on the film.

Formation of Surface Layer

First Layer

A surface layer is formed on the non-coated photoreceptor by a plasma CVD method using the film-forming apparatus shown in FIGS. 4A and 4B.

First, the non-coated photoreceptor is mounted on a substrate holder 13, and is placed in a film-forming chamber 10, and then the interior of the film-forming chamber 10 is evacuated to a pressure of $10\times10^{-2}$ Pa. Thereafter, gases are supplied to the film-forming chamber 10 under the conditions shown in Tables 1A and 1B. Here, $H_2$, $N_2$, He-diluted oxygen (4 mol %) and $CH_4$ are introduced from a gas-supply tube 20, and hydrogen-diluted trimethyl gallium (hereinafter, also referred to as "hydrogen-diluted TMG"; concentration of trimethyl gallium being 10 mol %) is introduced through a gas inlet 15 and a shower nozzle 16.

In this state, the pressure in the film-forming chamber 10 is adjusted to the values shown in Tables 1A and 1B by adjusting a conductance valve (not shown in the drawings), and electric discharge is conducted from a flat plate electrode 19 by setting a radiofrequency wave at 13.65 MHz to the output values shown in Tables 1A and 1B, and matching with a tuner such that the reflected wave is 0 W, using a high-frequency power supply unit 18 and a matching box (not shown in the drawings).

In this state, a first layer is formed in the film-forming time shown in Tables 1A and 1B, while rotating the non-coated photoreceptors at a speed of 40 rpm. A total of five samples of the first layer are formed under the same conditions. Among these five samples, four samples are formed directly on the non-coated photoreceptor. One sample is formed on a monocrystal silicon substrate (5 mm×10 mm; hereinafter also referred to as "Si substrate") adhered with adhesive tape at the center of the non-coated photoreceptor in the axial direction thereof, whereby an Si reference sample having a first layer formed thereon is obtained.

The hydrogen-diluted trimethylgallium gas is supplied by bubbling a hydrogen carrier gas into trimethylgallium kept at 0° C. The obtained photoreceptor is allowed to stand at a temperature of 20° C. for 24 hours.

Second Layer

In a manner similar to that of the first layer, a total of five samples of the second layers are formed on the first layer on the photoreceptor, except that the film-forming conditions are changed to the conditions shown in Tables 1A and 1B. One sample is formed on a fresh Si substrate, on which no other layer is formed, which is adhered to the non-coated photoreceptor after removal of the Si substrate adhered at the time of the first layer formation, whereby an Si reference sample having a second layer formed thereon is obtained.

Thus, four photoreceptor samples A1, one Si reference sample with the first layer, and one Si reference sample with the second layer are obtained.

Preparation of Photoreceptors A2 to A11

As non-coated photoreceptors, photoreceptors similar to the photoreceptor used for preparing the photoreceptor A1 are prepared. Subsequently, surface layers are formed in a manner similar to the preparation of the photoreceptor A1, except that the film-forming conditions for forming first layers and second layers are changed to the conditions shown in Tables 1A and 1B. Thus, four units for each of the photoreceptors A2 to A11, one each of the Si reference sample with the first layer, and one each of the Si reference sample with the second layer, are obtained.

Preparation of Photoreceptors B1 to B4

As non-coated photoreceptors, photoreceptors similar to the photoreceptor used for preparing the photoreceptor A1 are prepared. Subsequently, surface layers are formed in a manner similar to the preparation of the photoreceptor A1, except that the film-forming conditions for forming first layers, second layers, and a monolayer are changed to the conditions shown in Tables 1A and 1B. Thus, four units for each of the photoreceptors B1 to B4, one each of the Si reference sample with the first layer, one each of the Si reference sample with the second layer, and one Si reference sample with a monolayer are obtained.

With regard to the photoreceptors A1 to A9 and the photoreceptors B1-B4, the refractive index and the layer thickness for each layer of the reference sample of the organic photosensitive layer, the reference sample of the first layer, and the reference sample of the second layer are measured and analyzed by spectroscopic ellipsometry. For the measurements, a spectroscopic ellipsometer (trade name; M-2000, manufactured by J.A. Woolam Co., Inc.) is used, parameters Δ and φ are measured at three incident angles in a range of from 1,500 nm to 200 nm, and obtained data are analyzed with analysis software WVAS32 (trade name, manufactured by J.A. Woolam Co., Inc.), whereby the real number part n and the imaginary part k in the complex refractive index, and the layer thickness d are obtained. The results of n and d for each layer are shown in Table 2.

The film-forming conditions for each photoreceptor are shown in Tables 1A, 1B and 2.

TABLE 1A

| | | | Film-Forming Conditions | | | | | | | | | | | | |
|---|---|---|---|---|---|---|---|---|---|---|---|---|---|---|---|
| | | | Gas Flow Rate (sccm) | | | | | Radio-frequency Wave Output | Pressure | Film-Forming Time | Layer composition (Atomic %) | | | | |
| | Photo-receptor | Layer Structure | Hydrogen-diluted TMG | He-diluted $CH_4$ | He-diluted 4% $O_2$ | He-diluted $N_2$ | He-diluted $H_2$ | (W) | (Pa) | (min.) | Ga | O | H | N | C |
| Example 1 | A1 | 1st Layer | 4 | 0 | 10 | 0 | 50 | 125 | 5 | 33 | 36 | 49 | 15 | 0 | 0 |
| | | 2nd Layer | 4 | 0 | 5 | 0 | 50 | 125 | 5 | 180 | 36 | 44 | 20 | 0 | 0 |
| Example 2 | A2 | 1st Layer | 4 | 0 | 10 | 0 | 50 | 125 | 5 | 18 | 36 | 49 | 15 | 0 | 0 |
| | | 2nd Layer | 4 | 0 | 5 | 0 | 50 | 125 | 5 | 180 | 36 | 44 | 20 | 0 | 0 |
| Example 3 | A3 | 1st Layer | 4 | 0 | 10 | 0 | 50 | 125 | 5 | 26 | 36 | 49 | 15 | 0 | 0 |
| | | 2nd Layer | 4 | 0 | 5 | 0 | 50 | 125 | 5 | 180 | 36 | 44 | 20 | 0 | 0 |
| Example 4 | A4 | 1st Layer | 4 | 0 | 10 | 0 | 50 | 125 | 5 | 49 | 36 | 49 | 15 | 0 | 0 |
| | | 2nd Layer | 4 | 0 | 5 | 0 | 50 | 125 | 5 | 180 | 36 | 44 | 20 | 0 | 0 |
| Example 5 | A5 | 1st Layer | 4 | 0 | 10 | 0 | 50 | 125 | 5 | 40 | 36 | 49 | 15 | 0 | 0 |
| | | 2nd Layer | 4 | 0 | 5 | 0 | 50 | 125 | 5 | 180 | 36 | 44 | 20 | 0 | 0 |
| Example 6 | A6 | 1st Layer | 4 | 0 | 7 | 0 | 50 | 90 | 5 | 35 | 34 | 46 | 17 | 0 | 3 |
| | | 2nd Layer | 4 | 0 | 5 | 0 | 50 | 125 | 5 | 180 | 36 | 44 | 20 | 0 | 0 |
| Example 7 | A7 | 1st Layer | 4 | 0 | 3.5 | 0 | 50 | 90 | 5 | 40 | 35 | 43 | 19 | 0 | 3 |
| | | 2nd Layer | 4 | 0 | 5 | 0 | 50 | 125 | 5 | 180 | 36 | 44 | 20 | 0 | 0 |
| Example 8 | A8 | 1st Layer | 4 | 0 | 7 | 0 | 50 | 125 | 5 | 35 | 36 | 46 | 18 | 0 | 0 |
| | | 2nd Layer | 4 | 0 | 0 | 20 | 0 | 150 | 10 | 330 | 41 | 5 | 16 | 38 | 0 |
| Example 9 | A9 | 1st Layer | 0 | 50 | 0 | 0 | 10 | 150 | 20 | 43 | 0 | 2 | 34 | 0 | 64 |
| | | 2nd Layer | 0 | 50 | 0 | 0 | 0 | 150 | 20 | 200 | 0 | 2 | 31 | 0 | 67 |
| Example 10 | A10 | 1st Layer | 4 | 0 | 10 | 0 | 50 | 125 | 5 | 100 | 36 | 49 | 15 | 0 | 0 |
| | | 2nd Layer | 4 | 0 | 5 | 0 | 50 | 125 | 5 | 180 | 36 | 44 | 20 | 0 | 0 |
| Example 11 | A11 | 1st Layer | 4 | 0 | 10 | 0 | 50 | 125 | 5 | 165 | 36 | 49 | 15 | 0 | 0 |
| | | 2nd Layer | 4 | 0 | 5 | 0 | 50 | 125 | 5 | 180 | 36 | 44 | 20 | 0 | 0 |

TABLE 1B

| | Photo-receptor | Layer Structure | Film-Forming Conditions: Gas Flow Rate (sccm): Hydrogen-diluted TMG | He-diluted $CH_4$ | He-diluted 4% $O_2$ | He-diluted $N_2$ | He-diluted $H_2$ | Radio-frequency Wave Output (W) | Pressure (Pa) | Film-Forming Time (min.) | Layer composition (Atomic %): Ga | O | H | N | C |
|---|---|---|---|---|---|---|---|---|---|---|---|---|---|---|---|
| Comparative Example 1 | B1 | 1st Layer | 4 | 0 | 10 | 0 | 50 | 125 | 5 | 15 | 36 | 49 | 15 | 0 | 0 |
| | | 2nd Layer | 4 | 0 | 5 | 0 | 50 | 125 | 5 | 180 | 36 | 44 | 20 | 0 | 0 |
| Comparative Example 2 | B2 | 1st Layer | 4 | 0 | 10 | 0 | 50 | 125 | 5 | 52 | 36 | 49 | 15 | 0 | 0 |
| | | 2nd Layer | 4 | 0 | 5 | 0 | 50 | 125 | 5 | 180 | 36 | 44 | 20 | 0 | 0 |
| Comparative Example 3 | B3 | 1st Layer | 4 | 0 | 5 | 0 | 1 | 125 | 5 | 40 | 36 | 44 | 20 | 0 | 0 |
| | | 2nd Layer | 4 | 0 | 7 | 0 | 50 | 125 | 5 | 165 | 36 | 46 | 18 | 0 | 0 |
| Comparative Example 4 | B4 | Single Layer | 4 | 0 | 5 | 0 | 50 | 125 | 5 | 180 | 36 | 44 | 20 | 0 | 0 |

TABLE 2

| | Exposure Wavelength λ (nm) | Refractive Index: Photo-sensitive Layer n0 | Surface Layer (Two-Layered Structure): 1st Layer n1 | Surface Layer (Two-Layered Structure): 2nd Layer n2 | Surface Layer (Single Layer Structure) ns | \|n0 − n2\| or \|n0 − ns\| | λ/(8 × n1) + a × λ/(2 × n1) (nm) | 3 × λ/(8 × n1) + a × λ/(2 × n1) (nm) | Layer Thickness Surface Layer (Two-layered Structure): First Layer d1 (nm) | Second Layer d2 (nm) |
|---|---|---|---|---|---|---|---|---|---|---|
| Example 1 | 780 | 1.68 | 1.78 | 1.87 | — | 0.19 | 54.8 | 164.3 | 110 | 502.0 |
| Example 2 | 780 | 1.68 | 1.78 | 1.87 | — | 0.19 | 54.8 | 164.3 | 60 | 501.1 |
| Example 3 | 780 | 1.68 | 1.78 | 1.87 | — | 0.19 | 54.8 | 164.3 | 85 | 492.5 |
| Example 4 | 780 | 1.68 | 1.78 | 1.87 | — | 0.19 | 54.8 | 164.3 | 161 | 505.0 |
| Example 5 | 780 | 1.68 | 1.78 | 1.87 | — | 0.19 | 54.8 | 164.3 | 133 | 502.6 |
| Example 6 | 780 | 1.68 | 1.73 | 1.87 | — | 0.19 | 56.4 | 169.1 | 111 | 510.3 |
| Example 7 | 780 | 1.68 | 1.81 | 1.87 | — | 0.19 | 53.9 | 161.6 | 109 | 505.2 |
| Example 8 | 780 | 1.68 | 1.84 | 2 | — | 0.32 | 53.0 | 159.0 | 106 | 490.0 |
| Example 9 | 780 | 1.68 | 1.76 | 1.84 | — | 0.16 | 55.4 | 166.2 | 113 | 505.2 |
| Example 10 | 780 | 1.68 | 1.78 | 1.87 | — | 0.19 | 273.9 | 383.4 | 330 | 503.0 |
| Example 11 | 780 | 1.68 | 1.78 | 1.87 | — | 0.19 | 493.0 | 602.5 | 545 | 502.0 |
| Comparative Example 1 | 780 | 1.68 | 1.78 | 1.87 | — | 0.19 | 54.8 | 164.3 | 48 | 503.7 |
| Comparative Example 2 | 780 | 1.68 | 1.78 | 1.87 | — | 0.19 | 54.8 | 164.3 | 172 | 501.2 |
| Comparative Example 3 | 780 | 1.68 | 1.87 | 1.84 | — | 0.16 | 52.1 | 156.4 | 110 | 498.0 |
| Comparative Example 4 | 780 | 1.68 | — | — | 1.87 | 0.19 | — | — | — | ds = 498.8 |

The values of λ/(8 × n1) + a × λ/(2 × n1) and 3 × λ/(8 × n1) + a × λ/(2 × n1) for Examples 1 to 9 and Comparative Examples 1 to 4 are calculated by specifying the integer a as zero (0). The values of λ/(8 × n1) + a × λ/(2 × n1) and 3 × λ/(8 × n1) + a × λ/(2 × n1) for Example 10 are calculated by specifying the integer a as one (1). The values of λ/(8 × n1) + a × λ/(2 × n1) and 3 × λ/(8 × n1) + a × λ/(2 × n1) for Example 11 are calculated by specifying the integer a as two (2)

EVALUATION

For evaluation, an image forming apparatus (trade name: DOCUCENTRE COLOR a450, manufactured by Fuji Xerox Co., Ltd) is used. This apparatus is equipped with an intermediate transfer belt, a charging roll and a cleaning blade, which are members that contact the photoreceptor.

Figure 6:
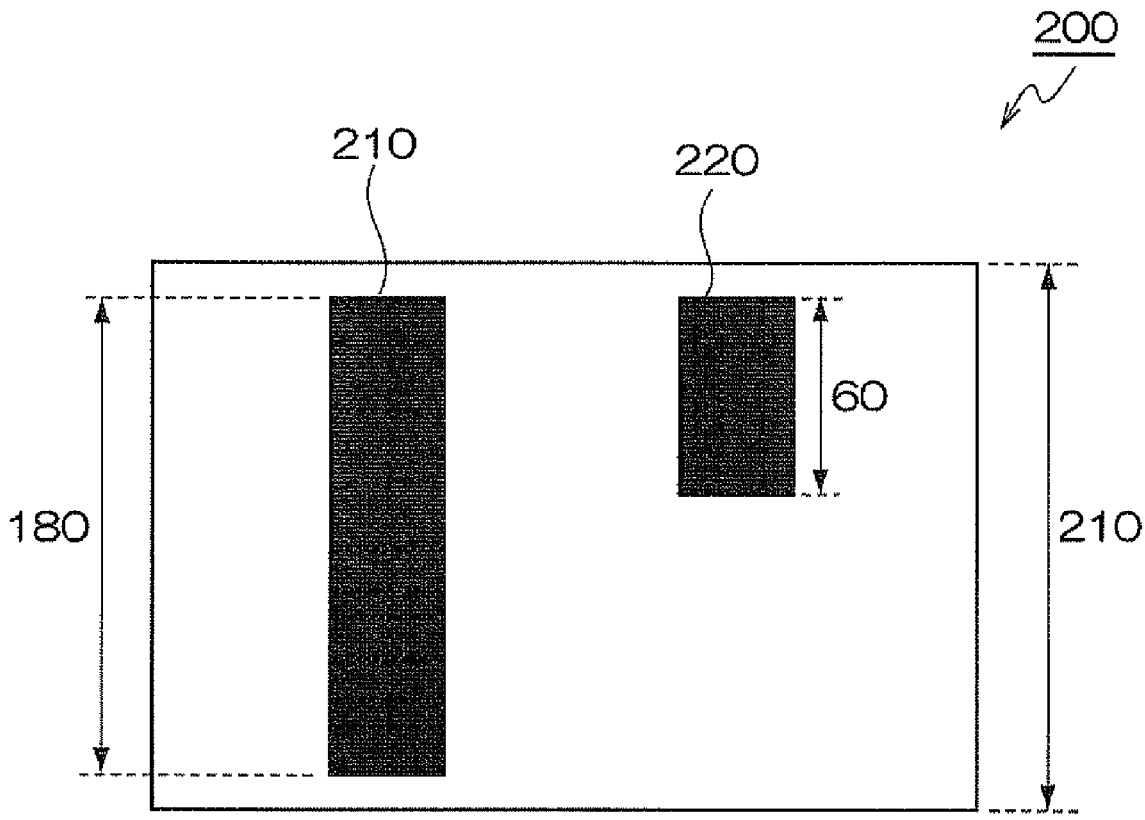
FIG. 6 is a plan view illustrating an image pattern of an original image on A4 size sheet of paper used in the evaluation in the Examples.

At the time of evaluation, after the photoreceptor is mounted, an image pattern as shown in FIG. 6 is sequentially printed on A4-size sheets of paper (trade name: P PAPER, manufactured by Fuji Xerox Co., Ltd) by setting the transverse direction of a sheet of paper as the paper feed direction in ambient conditions of a temperature of 20° C. and a humidity of 50% RH.

FIG. 6 is a plan view illustrating image patterns of an original image on an A4-size sheet used for the evaluation of the examples. Here, the original image 200 as shown in FIG. 6 includes two image patterns with a solid image 210 at a ratio of 90% in length (183 mm) (solid portion length 90% image), and a solid image 220 at a ratio of 30% in length (62 mm) (solid portion length 30% image), on the basis of the length of the transverse direction of a sheet of paper.

At the print tests, the difference between the surface potential VL90 (V) of the photoreceptor corresponding to the solid portion length 90% image, and the surface potential VL30 (V) of the photoreceptor corresponding to the solid portion length 30% image (difference in surface potential ΔVL (V)=|VL90−VL30|), is measured for each of the four units of the photoreceptors prepared under respective conditions, in the state after the initial print, 30,000 prints, 60,000 prints and 90,000 prints are formed, respectively. Further, the maximum values of the differences in surface potential ΔVL, in the states after the initial print (first print), 30,000 prints, 60,000 prints and 90,000 prints are determined as variations in the maximum surface potential (value $\Delta VL_{max}$). The surface potential and the depth of abrasion are measured according to the following procedure.

The main characteristic values of the photoreceptors used for the evaluations and the evaluation results are shown in Table 3.

Surface Potential

The photoreceptor having the surface layer thereon is removed from the image forming apparatus, in which the photoreceptor is installed, after a predetermined number of prints is formed, and the surface of the photoreceptor is irradiated with exposure light while scanning (light source: semiconductor laser; wavelength: 780 nm; output power: 5 mW), while the photoreceptor is rotated at 40 rpm in a charged state at −700 V having been charged with a scorotron charger.

Further, the exposure amount is set to a condition of −350V when the non-coated photoreceptor prior to forming the surface layer is exposed under conditions similar to the above-described conditions.

Next, the surface potential of the surface of the photoreceptor after exposure (region corresponding to the solid portion length 90% image and the solid portion length 30% image) are measured. For the measurement of the surface potential, a surface electrometer (trade name: MODEL 344; manufactured by TREK Japan KK) and a probe with a measurement region width of 10 mm (trade name: MODEL 555P-1; manufactured by TREK Japan KK) are used. In the measurement, the probe is disposed in such a manner that the distance between the probe and the photoreceptor is set to 2 mm, and the surface potential for each LV90 and LV30, respectively, is measured as a mean value at four points (at an angle of 0°, 90°, 180° and 270°) in the circumferential direction of the photoreceptor.

Depth of Abrasion

The photoreceptor is cut out in a direction vertical to the surface of the photoreceptor after the measurement of potential, and the surface of the cut out photoreceptor is covered with a polymer resin and embedded therein. Thereafter, the embedded photoreceptor is cut with a microtome, and the cut surface is observed under a scanning electron microscope (SEM) (trade name: JSM6340F; manufactured by JEOL Ltd.; magnification: 20,000), and the thickness of the surface layer d1+d2, or ds, for each of samples is obtained. The observations are carried out at four points (at an angle of 0°, 90°, 180° and 270°) in the circumferential direction of the photoreceptor, and the mean value of the obtained values is regarded as the thickness of the surface layer. The depth of abrasion is obtained from the difference in the thickness of the surface layers of the photoreceptor samples between the initial stage and after the test.

TABLE 3

| | Difference in Surface Potential ΔVL (V) and Depth of Abrasion D90, D30 (nm) | | | | | | | | | | | | Variations in |
|---|---|---|---|---|---|---|---|---|---|---|---|---|---|
| | Initial | | | After 30,000 prints | | | After 60,000 prints | | | After 90,000 prints | | | Maximum Exposure |
| | ΔVL | D90 | D30 | ΔVL | D90 | D30 | ΔVL | D90 | D30 | ΔVL | D90 | D30 | Potential |
| Example 1 | 2.2 | 0 | 0 | 2.5 | 90 | 55 | 3.6 | 178 | 109 | 3.3 | 267 | 163 | 3.6 |
| Example 2 | 2.4 | 0 | 0 | 5.5 | 92 | 52 | 9.5 | 180 | 112 | 7.5 | 260 | 158 | 9.5 |
| Example 3 | 2.2 | 0 | 0 | 6.9 | 93 | 55 | 3.3 | 182 | 100 | 6.8 | 255 | 158 | 6.9 |
| Example 4 | 2.5 | 0 | 0 | 5.7 | 89 | 54 | 3.9 | 188 | 103 | 9.2 | 270 | 162 | 9.2 |
| Example 5 | 2.7 | 0 | 0 | 6.1 | 91 | 55 | 4.1 | 185 | 104 | 7.2 | 269 | 165 | 7.2 |
| Example 6 | 2.3 | 0 | 0 | 4.5 | 90 | 53 | 9.7 | 184 | 108 | 3.3 | 266 | 159 | 9.7 |
| Example 7 | 2.3 | 0 | 0 | 5.5 | 91 | 50 | 9.5 | 180 | 109 | 4.5 | 261 | 154 | 9.5 |
| Example 8 | 2.7 | 0 | 0 | 2.2 | 80 | 50 | 5 | 155 | 100 | 3.8 | 232 | 145 | 5 |
| Example 9 | 1.8 | 0 | 0 | 3.2 | 75 | 52 | 4.5 | 145 | 102 | 3.8 | 211 | 147 | 4.5 |
| Example 10 | 2.3 | 0 | 0 | 2.4 | 91 | 54 | 3.0 | 179 | 110 | 3.2 | 268 | 164 | 3.2 |
| Example 11 | 2.1 | 0 | 0 | 2.6 | 90 | 55 | 3.5 | 178 | 111 | 2.9 | 267 | 160 | 3.5 |
| Comparative Example 1 | 2.4 | 0 | 0 | 10.5 | 91 | 51 | 13.8 | 183 | 105 | 7.5 | 269 | 159 | 13.8 |
| Comparative Example 2 | 2.2 | 0 | 0 | 6.5 | 93 | 55 | 5.5 | 180 | 105 | 13.5 | 268 | 165 | 13.5 |
| Comparative Example 3 | 2.4 | 0 | 0 | 9.7 | 96 | 53 | 12.9 | 182 | 110 | 6.3 | 280 | 161 | 12.9 |
| Comparative Example 4 | 2.2 | 0 | 0 | 11.2 | 90 | 54 | 21.5 | 184 | 110 | 8.5 | 258 | 162 | 21.5 |

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its applications, thereby enabling others skilled in the art to understand the invention for various embodiments and with the various modifications as are suited to particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising an organic photosensitive layer and a surface layer provided at a surface of the organic photosensitive layer, the surface layer including a first layer which is provided at a photosensitive layer side and has a refractive index of n1 and a second layer which is provided at an opposite side of the first layer to the organic photosensitive layer and has a refractive index of n2, and the photoreceptor satisfying the following Inequalities (1) to (3):

$$|n0-n2|>0.1 \quad \text{Inequality (1)}$$

$$n0<n1<n2, \text{ or } n0>n1>n2 \quad \text{Inequality (2)}$$

$$\lambda/(8\times n1)+a\times\lambda/(2\times n1)\leq d1\leq 3\times\lambda/(8\times n1)+a\times\lambda/(2\times n1) \quad \text{Inequality (3)}$$

where, in Inequalities (1) to (3), n0 represents the refractive index of the photosensitive layer, n1 represents the refractive index of the first layer, n2 represents the refractive index of the second layer, d1 represents the film thickness (nm) of the first layer, a represents an integer of 0 or more, and λ represents the wavelength (nm) of light with which the surface of the photoreceptor is irradiated when an electrostatic latent image is formed, wherein the thickness of the second layer is 50 nm or more, and at least one of the first layer or the second layer comprises Ga, oxygen, and hydrogen.

2. The electrophotographic photoreceptor of claim 1, wherein the electrophotographic photoreceptor satisfies the following Inequality (4):

$$(n0+n2)/2-|(n0-n2)/4|\leq n1\leq(n0+n2)/2+|(n0-n2)/4| \quad \text{Inequality (4)}$$

and, in Inequality (4), n0 represents the refractive index of the photosensitive layer, n1 represents the refractive index of the first layer, and n2 represents the refractive index of the second layer.

3. The electrophotographic photoreceptor of claim 1, wherein the electrophotographic photoreceptor satisfies the following Inequality (5):

$$(n0+n2)/2-|(n0-n2)/8|\leq n1\leq(n0+n2)/2+|(n0-n2)/8| \quad \text{Inequality (5)}$$

and, in Inequality (5), n0 represents the refractive index of the photosensitive layer, n1 represents the refractive index of the first layer, and n2 represents the refractive index of the second layer.

4. The electrophotographic photoreceptor of claim 1, wherein the photosensitive layer is an organic photosensitive layer and at least one of the first layer or the second layer comprises an amorphous carbon.

5. An image-forming apparatus comprising:

an electrophotographic photoreceptor comprising an organic photosensitive layer and a surface layer provided at a surface of the organic photosensitive layer;

a charging unit for charging a surface of the electrophotographic photoreceptor;

an electrostatic latent image forming unit for forming an electrostatic latent image on the charged electrophotographic photoreceptor;

a developing unit for forming a toner image by developing the electrostatic latent image with a toner-containing developer;

a transfer unit for transferring the toner image onto a recording medium; a fixing unit for fixing the toner image onto the recording medium; and a cleaning unit for cleaning the surface of the photoreceptor after transferring the toner image onto the recording medium, the surface layer including a first layer which is provided at a photosensitive layer side and has a refractive index of n1 and a second layer which is provided at an opposite side of the first layer to the organic photosensitive layer and has a refractive index of n2, and the photoreceptor satisfying the following Inequalities (6) to (8):

$$|n0-n2|>0.1 \quad \text{Inequality (6):}$$

$$n0<n1<n2, \text{ or } n0>n1>n2 \quad \text{Inequality (7):}$$

$$\lambda/(8\times n1)+a+\lambda/(2\times n1)\leq d1\leq 3\times\lambda(8\times n1)+a\times\lambda/(2\times n1) \quad \text{Inequality (8):}$$

where, in Inequalities (6) to (8), n0 represents the refractive index of the organic photosensitive layer, n1 represents the refractive index of the first layer, n2 represents the refractive index of the second layer, d1 represents the film thickness (nm) of the first layer, a represents an integer of 0 or more, and λ represents the wavelength (nm) of light with which the surface of the photoreceptor is irradiated when an electrostatic latent image is formed, wherein the thickness of the second layer is 50 nm or more, and at least one of the first layer or the second layer comprises Ga, oxygen and hydrogen.

6. The image-forming apparatus of claim 5, wherein the charging unit is a charging roll.

7. The image-forming apparatus of claim 5, wherein the cleaning unit is a cleaning blade.

8. The image-forming apparatus of claim 5, wherein the charging unit is a charging roll, and the cleaning unit is a cleaning blade.

9. The image-forming apparatus of claim 5, wherein the image-forming apparatus further contains an intermediate transfer medium and the toner image is temporarily transferred from the surface of the photoreceptor onto a surface of the intermediate transfer medium, and then transferred onto the recording medium.

10. A process cartridge comprising an electrophotographic photoreceptor an organic photosensitive layer and a surface layer provided at a surface of the organic photosensitive layer, the process cartridge being detachably attached to a main body of an image forming apparatus, the surface layer including a first layer which is provided at a photosensitive layer side and has a refractive index of n1 and a second layer which is provided at an opposite side of the first layer to the organic photosensitive layer and has a refractive index of n2, and the photoreceptor satisfying the following Inequalities (9) to (11):

$$|n0-n2|>0.1 \quad \text{Inequality (9):}$$

$$n0<n1<n2, \text{ or } n0>n1>n2 \quad \text{Inequality (10):}$$

$$\lambda/(8\times n1)+a\times\lambda/(2\times n1)\leq d1\leq 3\times\lambda/(8\times n1)+a\times\lambda/(2\times n1) \quad \text{Inequality (11):}$$

where, in Inequalities (9) to (11), n0 represents the refractive index of the organic photosensitive layer, n1 represents the refractive index of the first layer, n2 represents the refractive index of the second layer, d1 represents the film thickness (nm) of the first layer, a represents an integer of 0 or more, and λ represents the wavelength (nm) of light with which the surface of the photoreceptor is irradiated when an electrostatic latent image is formed, wherein the thickness of the second layer is 50 nm or more, and at least one of the first layer or the second layer comprises Ga, oxygen and hydrogen.

11. The electrophotographic photoreceptor of claim 1, wherein the organic photosensitive layer comprises a charge generation layer and a charge transport layer, and the charge generation layer, the charge transport layer, and the surface layer are provided in the electrophotographic photoreceptor in this order.

12. The image-forming apparatus of claim 5, wherein the organic photosensitive layer comprises a charge generation layer and a charge transport layer, and the charge generation layer, the charge transport layer, and the surface layer are provided in the electrophotographic photoreceptor in this order.

13. The process cartridge of claim 10, wherein the organic photosensitive layer comprises a charge generation layer and a charge transport layer, and the charge generation layer, the charge transport layer, and the surface layer are provided in the electrophotographic photoreceptor in this order.

14. The electrophotographic photoreceptor of claim 1, wherein the organic photosensitive layer is a functionally integrated layer.

15. The image-forming apparatus of claim 5, wherein the organic photosensitive layer is a functionally integrated layer.

16. The process cartridge of claim 10, wherein the organic photosensitive layer is a functionally integrated layer.

* * * * *